US012593885B2

(12) United States Patent
Boutin

(10) Patent No.: US 12,593,885 B2
(45) Date of Patent: Apr. 7, 2026

(54) SHOCK-ABSORBING ASSEMBLY AND BODY PROTECTION DEVICE INCLUDING SAME

(71) Applicant: 9376-4058 QUEBEC INC., Saint-Remi (CA)

(72) Inventor: Gabriel Boutin, Quebec (CA)

(73) Assignee: 9376-4058 QUEBEC INC., Saint-Remi (CA)

( * ) Notice: Subject to any disclaimer, the term of this patent is extended or adjusted under 35 U.S.C. 154(b) by 618 days.

(21) Appl. No.: 17/257,567

(22) PCT Filed: Jul. 4, 2019

(86) PCT No.: PCT/CA2019/050923
§ 371 (c)(1),
(2) Date: Jan. 1, 2021

(87) PCT Pub. No.: WO2020/006637
PCT Pub. Date: Jan. 9, 2020

(65) Prior Publication Data

US 2021/0315305 A1 Oct. 14, 2021

Related U.S. Application Data

(60) Provisional application No. 62/693,960, filed on Jul. 4, 2018.

(51) Int. Cl.
*A42B 3/06* (2006.01)
*A41D 13/015* (2006.01)
*A42B 3/12* (2006.01)

(52) U.S. Cl.
CPC ..... *A42B 3/06* (2013.01); *A41D 13/0156* (2013.01); *A42B 3/12* (2013.01)

(58) Field of Classification Search
CPC ..... A42B 3/06; A42B 3/12; A41D 13/0156
See application file for complete search history.

(56) References Cited

U.S. PATENT DOCUMENTS 5,950,244 A * 9/1999 Fournier ..... A42B 3/128 2/425
7,673,351 B2 * 3/2010 Copeland ..... A41D 31/285 2/425

(Continued)

FOREIGN PATENT DOCUMENTS

CA 3033306 A1 4/2019
CN 201831005 U 5/2011

(Continued)

*Primary Examiner* — Tajash D Patel
(74) *Attorney, Agent, or Firm* — DECODE Legal Inc.

(57) ABSTRACT

There is provided a shock-absorbing assembly engageable with a human body part, such as a human head, to protect same. The shock-absorbing assembly comprises a shock-absorbing core including an inner surface configured to face at least a portion of the human body part; and a body contact seat assembly comprising: a plurality of spaced-apart resilient posts mounted to the shock-absorbing core, each one of the resilient posts having a portion protruding from the inner surface of the shock-absorbing core; and a body contact seat mounted to the shock-absorbing core via the protruding portions of the plurality of resilient posts, so that the body contact seat is in spaced relationship with the inner surface of the shock-absorbing core and at least one of slidable, displaceable, shearable and twistable with respect to the inner surface thereof. There is also provided a helmet including such a shock-absorbing assembly and a shock-absorbing kit.

17 Claims, 25 Drawing Sheets

(56) References Cited

U.S. PATENT DOCUMENTS

| | | | | |
|---|---|---|---|---|
| 8,566,968 | B2 * | 10/2013 | Marzec | A42B 3/064 2/411 |
| 9,462,842 | B2 * | 10/2016 | Hoshizaki | A42B 3/12 |
| 10,376,009 | B2 * | 8/2019 | Kennedy | F16F 1/54 |
| 2017/0027267 | A1 | 2/2017 | Morgan | |
| 2019/0231018 | A1 | 8/2019 | Boutin | |

FOREIGN PATENT DOCUMENTS

| | | | |
|---|---|---|---|
| CN | 205162030 | U | 4/2016 |
| TW | M328799 | U | 3/2008 |

* cited by examiner

SHOCK-ABSORBING ASSEMBLY AND BODY PROTECTION DEVICE INCLUDING SAME

CROSS-REFERENCE TO RELATED APPLICATION

The present application claims priority from U.S. provisional patent application No. 62/693,960, filed on Jul. 4, 2018, and entitled "HELMET AND HELMET SHOCK-ABSORBING ASSEMBLY", the disclosure of which being hereby incorporated by reference in its entirety.

TECHNICAL FIELD

The technical field generally relates to body protection devices, such as protective helmets. More particularly, the technical field relates to a shock-absorbing assembly and to a body protection device comprising the same.

BACKGROUND

Body protection devices are used to protect a wearer's body part from accidental trauma. For instance, protective helmets and headwear are used to protect a wearer's head from accidental trauma by protecting the head in case of high impact collisions. Helmets can be worn by workers, such as construction workers, or athletes in different sports including and without being limitative to cycling, football, baseball, hockey, lacrosse, skiing, snowboarding, and horseback riding.

Typically, helmets are made of a hard and durable material configured to deflect and disperse the external forces applied thereto. Most helmets are made of a semi-rigid outer shell covering and distributing the force of impact to a compressible foam inner layer.

However, because they are typically worn for extended periods of time, helmets should be relatively lightweight while maintaining their head protection capabilities. For further comfort, some wearers also required that helmets are provided with increased aeration, while having good shock absorption properties.

Therefore, there is always needs for improved protective helmets that can provide cranial protection while being comfortable for the wearer, i.e. relatively lightweight and aerated.

BRIEF SUMMARY

It is therefore an aim of the present invention to address the above-mentioned issues.

According to a general aspect, there is provided a helmet engageable with a human head portion. The helmet comprises a shock-absorbing core including an inner surface configured to face at least a section of the human head portion when the helmet is worn; and a plurality of deformable head contact devices mounted to the shock-absorbing core and having a portion protruding from the inner surface of the shock-absorbing core and including a head engaging surface spaced-apart from the inner surface of the shock-absorbing core. The head engaging surfaces of the plurality of deformable head contact devices define together a head contact seat.

According to another general aspect, there is provided a helmet engageable with a human head portion. The helmet comprises an outer shell including an inner surface and an outwardly facing surface; a shock-absorbing core including an inner surface configured to face at least a section of the human head portion when the helmet is worn and an opposed outer surface facing the inner surface of the outer shell; and a plurality of resilient pads extending from one of the inner surface of the outer shell and the outer surface of the shock-absorbing core and designed to contact the other of the inner surface of the outer shell and the outer surface of the shock-absorbing core.

According to yet another general aspect, there is provided a head contact device for a helmet having a shock-absorbing core. The helmet comprises a body having a stem with a core engaging end engageable with the shock-absorbing core of the helmet and a head contact base extending from the stem at an end opposed to the core engaging end. The head contact base defines a head engaging surface configured to face and abut against at least a section of the human head portion when the helmet is worn.

According to yet another general aspect, there is provided a shock-absorbing kit designed to be secured to an inner surface of an outer shell of a helmet. The shock-absorbing kit has a shock-absorbing core with an inner surface and an opposed outer surface configured to be secured to the inner surface of the outer shell of the helmet; and a plurality of deformable head contact devices designed to be mounted to the shock-absorbing core and having a portion protruding from the inner surface of the shock-absorbing core when each of the plurality of deformable head contact devices is mounted to the shock-absorbing core. Each one of the plurality of deformable head contact devices includes a head engaging surface in the portion protruding from the inner surface of the shock-absorbing core and being spaced-apart from the inner surface of the shock-absorbing core. The head engaging surfaces of the plurality of deformable head contact devices define together a head contact seat.

According to yet another general aspect, there is provided a shock-absorbing kit designed to be secured to an inner surface of an outer shell of a helmet. The shock-absorbing kit has a shock-absorbing core with an outer surface configured to be secured to the inner surface of the outer shell of the helmet; and a plurality of resilient pads configured to extend from one of the inner surface of the outer shell and the outer surface of the shock-absorbing core and designed to contact the other of the inner surface of the outer shell and the outer surface of the shock-absorbing core when the shock-absorbing kit is secured to the inner surface of the outer shell of the helmet.

According to a general aspect, there is provided a shock-absorbing assembly for protecting a human body part. The shock-absorbing assembly comprises: a shock-absorbing core including an inner surface configured to face at least a portion of the human body part and an opposed outer surface; and a body contact seat assembly. The body contact seat assembly comprises: a plurality of spaced-apart resilient posts mounted to the shock-absorbing core, each one of the plurality of resilient posts having a portion protruding from the inner surface of the shock-absorbing core towards the human body part; and a body contact seat mounted to the shock-absorbing core via the protruding portions of the plurality of resilient posts, so that the body contact seat is in spaced relationship with the inner surface of the shock-absorbing core and at least one of slidable, displaceable, shearable, and twistable with respect to the inner surface thereof.

In an embodiment, the shock-absorbing core comprises a plurality of spaced-apart receiving openings extending therethrough and a plurality of inner ports formed in the inner surface with the inner ports being in communication with a respective one of the receiving openings. At least a plurality of the receiving openings can extend substantially continuously from the inner surface to the outer surface of the shock-absorbing core. Each one of the plurality of spaced-apart resilient posts can comprise a stem extending at least partially into one of the plurality of receiving openings, the stem including: a core-engaging end mounted to the shock-absorbing core; and a seat-mounting end, opposed to the core-engaging end, and being located outside the shock-absorbing core; wherein the body contact seat extends from the seat-mounting ends of the stems.

In an embodiment, wherein each one of the plurality of spaced-apart resilient posts comprises a stem having a section extending into the shock-absorbing core and a section extending outwardly from the shock-absorbing core, wherein the section extending into the shock-absorbing core comprises a core-engaging end mounted to the shock-absorbing core and the section extending outwardly from the shock-absorbing core comprises a seat-mounting end with the body contact seat extending from the seat-mounting ends of the stems. The stem can extend substantially perpendicular to an adjacent area of the inner surface of the shock-absorbing core. The shock-absorbing core can comprise a 3D internal structure extending between the inner surface and the outer surface, and the core-engaging end of the stem can be formed integral with the 3D internal structure of the shock-absorbing core. The core-engaging end of the stem can be detachably engageable with the shock-absorbing core. The core-engaging end can comprise a blocking head configured to limit the disengagement of the resilient post from the shock-absorbing core. The seat-mounting end of the stem can be located at a spacer distance from the inner surface of the shock-absorbing core. The spacer distance can represent at least about 10% of a length of the stem. The spacer distance can greater than at least about 30% of a thickness of the shock-absorbing core between the inner surface and the outer surface.

In an embodiment, a length of each of the plurality of spaced-apart resilient posts is at least about 50% of a thickness of the shock-absorbing core between the inner surface and the outer surface.

In an embodiment, a thickness of the body contact seat is less than about 10% of a thickness of the shock-absorbing core between the inner surface and the outer surface.

In an embodiment, the plurality of spaced-apart resilient posts are at least partially made of TPU.

In an embodiment, a length of the protruding portion of each of the plurality of spaced-apart resilient posts is at least about 30% of a length of corresponding resilient post.

In an embodiment, the body contact seat defines a body contact surface extending substantially parallel to the inner surface of the shock-absorbing core and spaced-apart thereof.

In an embodiment, the body contact seat comprises a plurality of body contact bases, each one being located at an end of a respective one of the resilient posts and spaced-apart from the inner surface of the shock-absorbing core, each one of the body contact bases having a body-engaging surface with a combination of the body-engaging surfaces defining the body contact seat.

In an embodiment, the body contact seat is mounted to and supported by a plurality of the resilient posts. The body contact seat can comprise a contact seat layer supported by the plurality of the resilient posts and having a plurality of aeration apertures formed therein.

In an embodiment, the human body part is a human head and the body contact seat at least partially conforms to the human head to at least partially cover a portion thereof.

According to another general aspect, there is provided a shock-absorbing assembly engageable with a human body part, comprising: a shock-absorbing core including an inner surface configured to face at least a section of the human body part and an opposed outer surface; and a plurality of spaced-apart resilient posts mounted to the shock-absorbing core, each one of the plurality of resilient posts having a portion protruding from the inner surface of the shock-absorbing core towards the human body part and including a body-engaging surface spaced-apart from the inner surface of the shock-absorbing core, the body-engaging surfaces of the plurality of resilient posts defining together a body contact seat.

In an embodiment, the shock-absorbing core comprises a plurality of spaced-apart receiving openings extending therethrough and a plurality of inner ports formed in the inner surface with the inner ports being in communication with a respective one of the receiving openings; and each one of the plurality of spaced-apart resilient posts comprises a body having: a stem having a section extending into one of the plurality of receiving openings of the shock-absorbing core and a section extending outwardly from the shock-absorbing core, wherein the section extending into the shock-absorbing core comprises a core-engaging end mounted to the shock-absorbing core and the section extending outwardly from the shock-absorbing core comprises a seat-mounting end; and a body contact base extending from the seat-mounting end of the stem, the body contact base defining the body-engaging surface configured to face and abut against at least a section of the human body part.

The stem can extend substantially perpendicular to an adjacent area of the inner surface of the shock-absorbing core. The shock-absorbing core can comprise a 3D internal structure extending between the inner surface and the outer surface, with the core-engaging end of the stem being formed integral with the 3D internal structure of the shock-absorbing core. The core-engaging end of the stem can be detachably engageable with the shock-absorbing core. The core-engaging end can comprise a blocking head configured to limit the disengagement of the resilient post from the shock-absorbing core. The seat-mounting end of the stem can be located at a spacer distance from the inner surface of the shock-absorbing core. The spacer distance can represent at least about 10% of a length of the stem. The spacer distance can be greater than at least about 30% of a thickness of the shock-absorbing core between the inner surface and the outer surface. The body contact bases of the plurality of spaced-apart resilient posts can extend at a substantially identical spacer distance from the inner surface of the shock-absorbing core.

The body contact bases can define together a discontinuous surface forming the body contact seat. At least some of the body contact bases can at least partially cover each other.

The plurality of spaced-apart resilient posts can be arranged at a distance from each other sufficient for the body contact bases to be spaced-apart from each other.

The shock-absorbing assembly can further comprise at least one body-engaging strap coupling the body-engaging surfaces of at least some of the plurality of spaced-apart resilient posts. The at least one body-engaging strap can comprise a linking portion extending between two spaced-apart resilient posts and at least two post-mounting portions securable to the body contact base of the two resilient posts.

In an embodiment, the body-engaging surface is substantially circular.

In an embodiment, the body-engaging surface extends in a body-engaging plane substantially transversal to an axis of the stem.

In an embodiment, the body-engaging surface is substantially parallel to a tangential plane defined at an intersection between the inner surface of the shock-absorbing core and the stem of the resilient post.

In an embodiment, the body contact bases of the plurality of resilient posts are formed integral with each other so that the body contact bases define together a substantially continuous surface forming the body contact seat.

According to still another general aspect, there is provided a helmet engageable with a human head portion. The helmet comprises: an outer shell including an inner surface and an outwardly facing surface; and a shock-absorbing assembly as described above, wherein the outer surface of the shock-absorbing core is connected to the inner surface of the outer shell.

In an embodiment, an area of the outer surface of the shock-absorbing core represents at least about 15% of an area of the inner surface of the outer shell.

In an embodiment, the helmet further comprises a plurality of shock-absorbing assemblies connected to each other, wherein an area of the outer surface of the shock-absorbing cores of the connected shock-absorbing assemblies represents at least about 75% of an area of the inner surface of the outer shell.

According to a further general aspect, there is provided a shock-absorbing kit designed to be secured to an inner surface of an outer shell of a body protection device for a human body part. The shock-absorbing kit comprising: a shock-absorbing core including an inner surface configured to face at least a portion of the human body part and an opposed outer surface engageable with the inner surface of the outer shell; and a body contact seat assembly. The body contact seat assembly comprises: a plurality of resilient posts designed to be mounted to the shock-absorbing core with a portion protruding from the inner surface of the shock-absorbing core and towards the portion of the human body part when mounted to the shock-absorbing core; and a body contact seat designed to be connected to the shock-absorbing core via the protruding portions of the plurality of resilient posts, for the body contact seat to be in spaced relationship with the inner surface of the shock-absorbing core and at least one of slidable, displaceable, shearable and twistable with respect to the inner surface of the shock-absorbing core when connected thereto.

In an embodiment, the body contact seat assembly comprises a plurality of body contact seat assemblies connectable to each other to cover the portion of the human body part.

In an embodiment, each one of the resilient posts comprises a portion extending into the shock-absorbing core and including a core-engaging end mountable to the shock-absorbing core.

In an embodiment, the body contact seat comprises a plurality of head contact bases, each one being located at an end of a respective one of the resilient posts and spaced-apart from the inner surface of the shock-absorbing core, each one of the head contact bases having a body-engaging surface with a combination of the body-engaging surfaces defining the body contact seat.

In an embodiment, the body contact seat is mounted to and supported by a plurality of the resilient posts. The body contact seat can comprise a contact seat layer supported by the plurality of the resilient posts and having a plurality of aeration apertures formed therein.

According to still a further general aspect, there is provided a shock-absorbing kit designed to be secured to an inner surface of an outer shell of a body protection device for a human body part. The shock-absorbing kit comprises: a shock-absorbing core including an inner surface configured to face at least a portion of the human body part and an opposed outer surface engageable with the inner surface of the outer shell; and a body contact seat assembly. The body contact seat assembly comprises: a plurality of resilient posts designed to be mounted with a portion protruding from the inner surface of the shock-absorbing core and towards the portion of the human body part when mounted to the shock-absorbing core and a body-engaging surface in the protruding portion is a spaced-apart configuration from the inner surface of the shock-absorbing core when the resilient posts are mounted thereto; and a body contact seat defined by the body-engaging surfaces of the plurality of resilient posts.

In an embodiment, each one of the resilient posts comprises a portion extending into the shock-absorbing core and including a core-engaging end mountable to the shock-absorbing core.

In an embodiment, each one of the resilient posts comprises a plurality of head contact bases, each one being located at an end of a respective one of the resilient posts and spaced-apart from the inner surface of the shock-absorbing core, each one of the head contact bases including a respective one of the body-engaging surfaces.

In an embodiment, the body contact seat further comprises at least one body-engaging strap engageable with at least some of the plurality of resilient posts.

DETAILED DESCRIPTION

Figure 1:
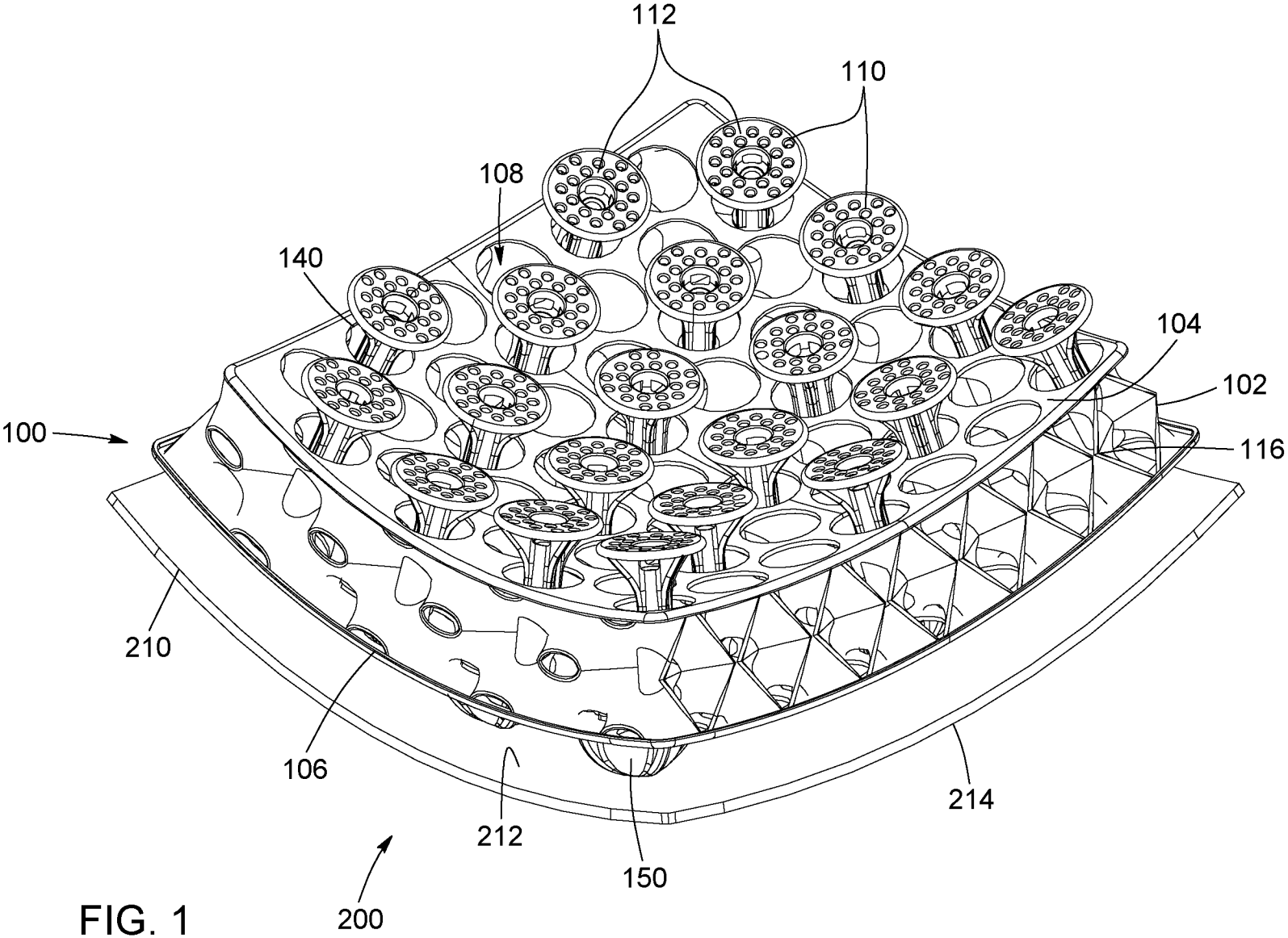
FIG. 1 is a bottom perspective view of a portion of a helmet in accordance with an embodiment, the helmet comprising a shock-absorbing assembly with a shock-absorbing core, resilient posts and resilient pads.
Figure 2:
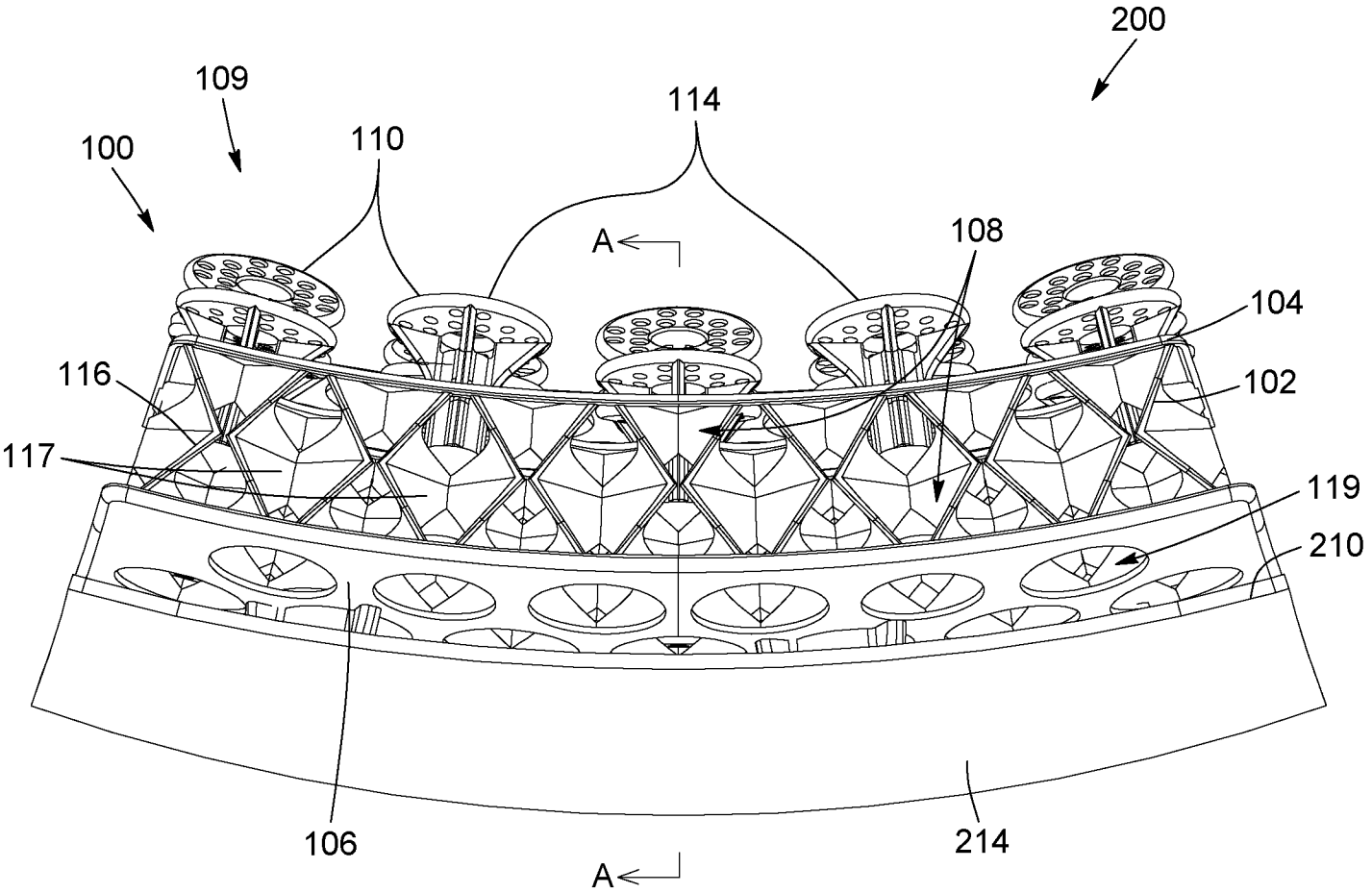
FIG. 2 is a top perspective view of the portion of the helmet of FIG. 1, the resilient pads being removed.

In the following description, the same numerical references refer to similar elements. Furthermore, for the sake of simplicity and clarity, namely so as to not unduly burden the figures with several references numbers, not all figures contain references to all the components and features, and references to some components and features may be found in only one figure, and components and features of the present disclosure which are illustrated in other figures can be easily inferred therefrom. The embodiments, geometrical configurations, materials mentioned and/or dimensions shown in the figures are optional, and are given for exemplification purposes only.

Moreover, it will be appreciated that positional descriptions such as "above", "below", "forward", "rearward" "left", "right" and the like should, unless otherwise indicated, be taken in the context of the figures only and should not be considered limiting. Moreover, the figures are meant to be illustrative of certain characteristics of a body protection device such as a helmet and are not necessarily to scale.

In the context of the present description, the terms "outer", "outwards", and "outwardly" are intended to mean away or distal from the body while the terms "inner", "inwards", and "inwardly" are intended to mean closer, proximal or adjacent to the body.

To provide a more concise description, some of the quantitative expressions given herein may be qualified with the term "about". It is understood that whether the term "about" is used explicitly or not, every quantity given herein is meant to refer to an actual given value, and it is also meant to refer to the approximation to such given value that would reasonably be inferred based on the ordinary skill in the art, including approximations due to the experimental and/or measurement conditions for such given value.

It is to be understood that the phraseology and terminology employed herein is not to be construed as limiting and are for descriptive purpose only.

The descriptions, examples, methods and materials presented in the claims and the specification are not to be construed as limiting but rather as illustrative only.

Meanings of technical and scientific terms used herein are to be commonly understood as by one of ordinary skill in the art to which the invention belongs, unless otherwise defined.

Embodiment of a Body Protection Device: Helmet

Generally described, a body protection device, for instance a helmet 200 or at least a section of a helmet 200, including a shock-absorbing assembly 100 is provided. The shock-absorbing assembly 100 may be of different kinds, as it will be described in detail below, but is intended, when comprised within the helmet 200, to provide or enhance head protection for a user wearing the helmet 200 when performing different activities, such as cycling, motorcycling, skiing, skating, skate boarding or any other sport for which a head protection from an impact may be required. The helmet could also be used in any application requiring a head protection such as, for instance and without being limitative, professional work or during transportation. As any helmet, the helmet 200 which will be described is typically worn to cover an upper and outer surface (or regions near to the upper and/or outer surface) of a human head portion, and to attenuate or, in some cases resist a given impact upon, for example a collision with a hard structure (e.g. pavement, rock, ice, and the like), and so to reduce or protect the user against injuries from the collision. It is to be understood by the person skilled in the art that the helmet 200 described herein has a shape similar to the helmets known in the art, i.e. the helmet 200 generally covers the entire top portion of the wearer. It is however possible, in some cases that a helmet portion extending from the front to the rear wearer's head covers only one hemisphere thereof or surrounds the wearer's head (i.e. has substantially the shape of a headband). It is thus understood that the helmet 200 necessarily comprises a head receiving cavity configured to receive or surround at least a portion of the head of the user.

In the following description, unless otherwise stated, the terms "inner", "inwards", "outer", "outwards" or other derived terms should be understood with reference to the head receiving cavity of the helmet 200.

Figure 15:
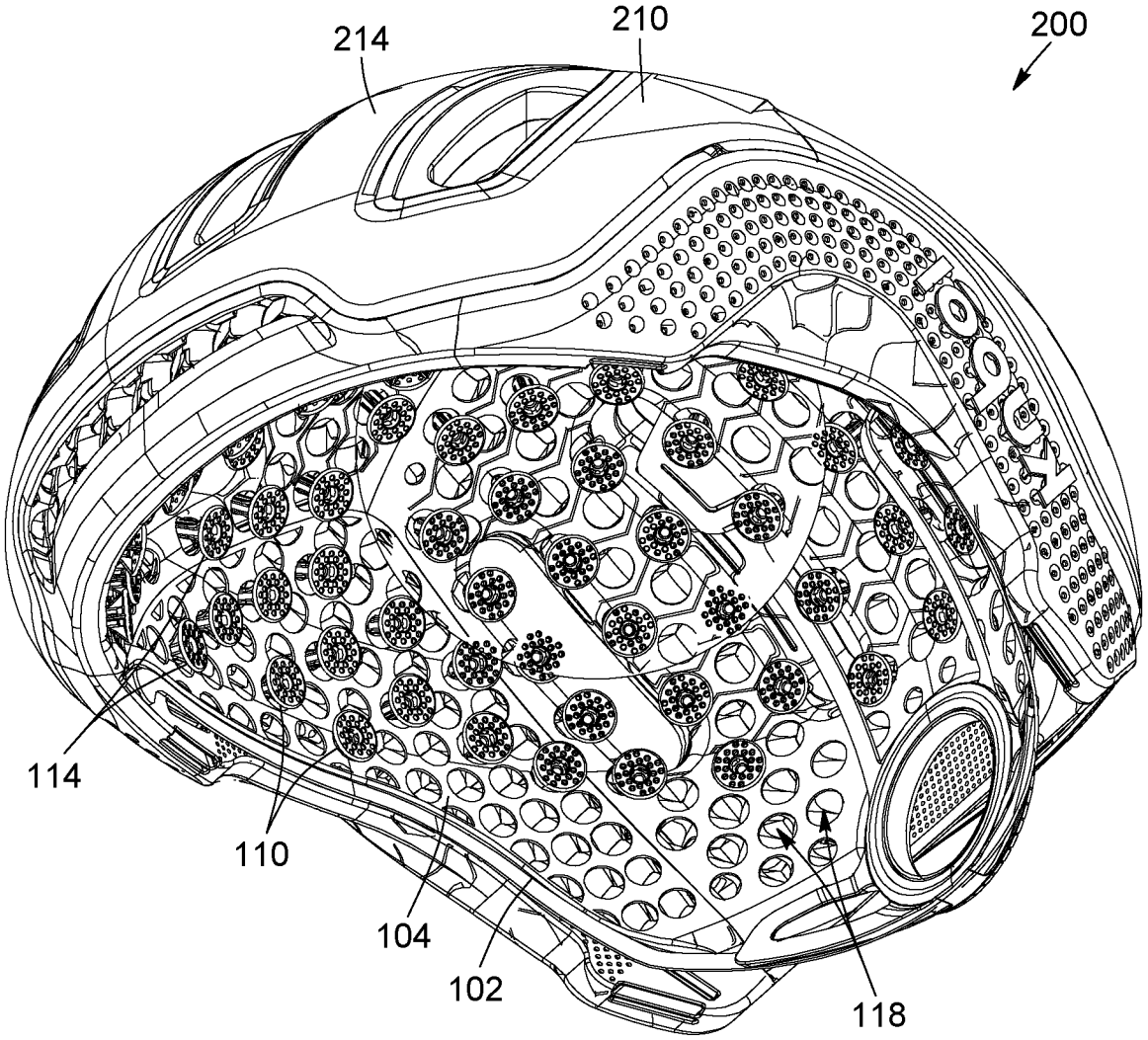
FIG. 15 is a bottom perspective view of a helmet in accordance with another embodiment, the helmet comprising a shock-absorbing assembly including a shock-absorbing core and a plurality of spaced-apart resilient posts.
Figure 16:
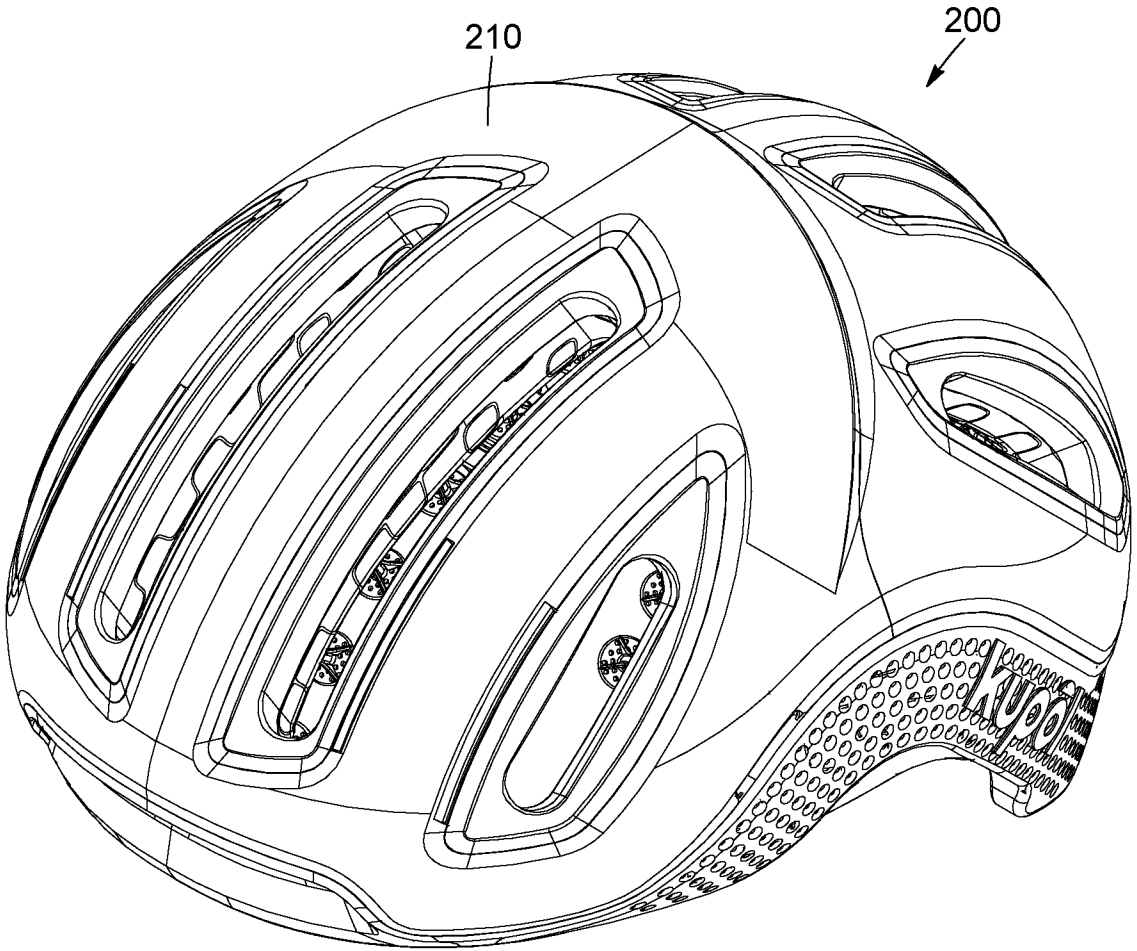
FIG. 16 is a top perspective view of the helmet of FIG. 15.
Figure 17:
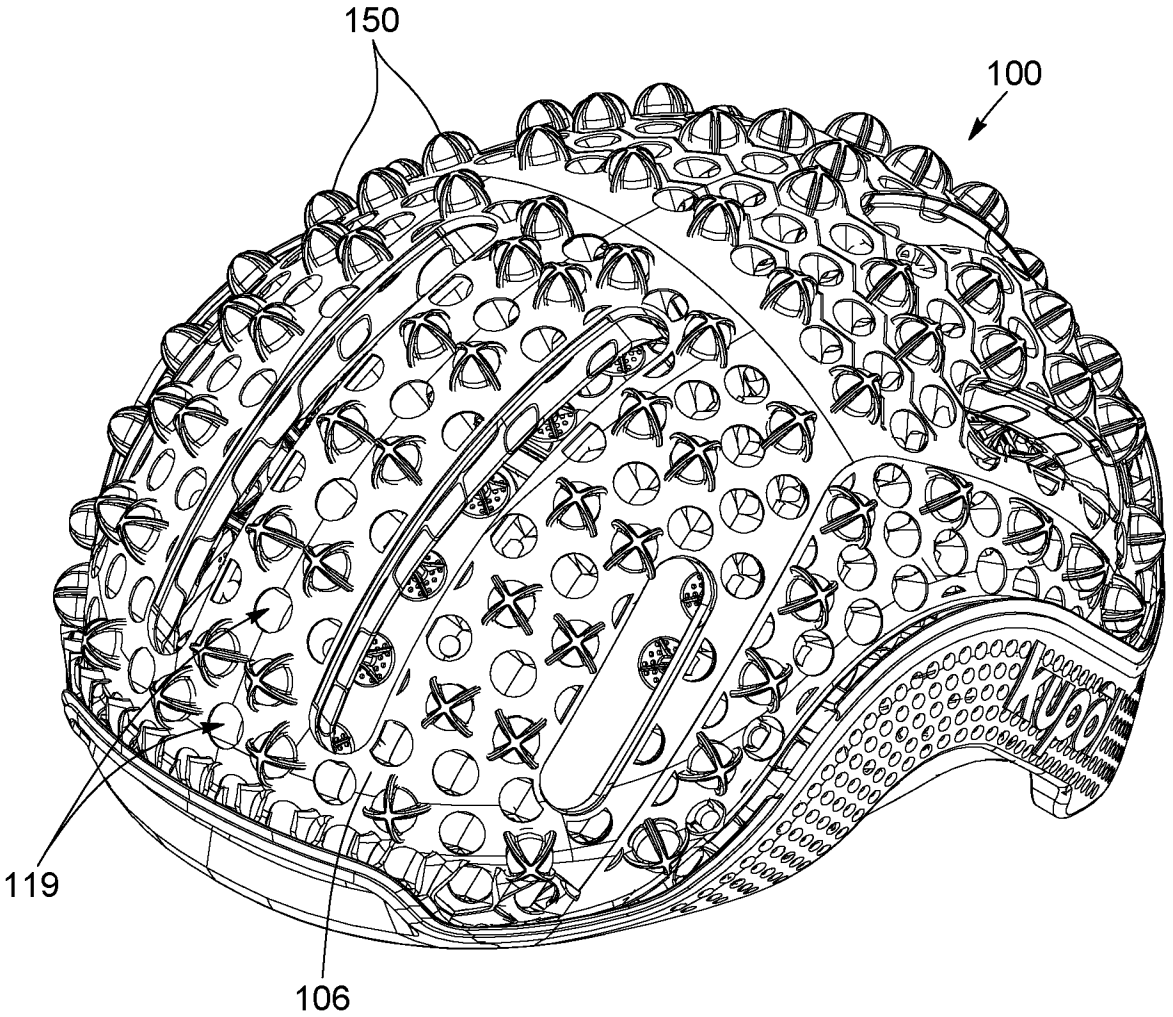
FIG. 17 is a top perspective view of the shock-absorbing assembly of the helmet shown in FIG. 15.

Referring to FIGS. 1 to 4 and to FIGS. 15 and 16, an embodiment of the helmet 200 (or a portion thereof) is shown.

The helmet 200 is configured to be engageable with a human head portion of a user and comprises an outer shell 210 including an inner surface 212 and an outwardly facing surface 214, opposed to the inner surface 212. The helmet 200 further comprises the shock-absorbing assembly 100 including at least a shock-absorbing core 102 including an inner surface 104 configured to face at least a section of the human head portion when the helmet 200 is worn and an opposed outer surface 106 facing the inner surface 212 of the outer shell 210 and configured to be secured—either directly or indirectly—to the inner surface 212 of the outer shell 210. In the non-limitative embodiment shown, the shock-absorbing assembly 100 further comprises a body contact seat assembly 109 including a plurality of spaced-apart resilient posts (or deformable head contact devices) 110 mounted to the shock-absorbing core 102, each of the plurality of spaced-apart resilient post 110 including a body engaging surface, for instance a head engaging surface 112. As detailed below, the securing of the spaced-apart resilient posts 110 to the shock-absorbing core 102 should be understood as encompassing either a removable mounting of the resilient posts 110 to the shock-absorbing core 102 or a substantially permanently mounting of the resilient posts 110 to the shock-absorbing core 102, for instance by being glued, welded or formed integral with a portion of an internal structure of the shock-absorbing core 102.

In the following description, the term post designates a piece configured to be mounted to the shock-absorbing core 102 in a substantially upright position with respect to shock-absorbing core. As detailed below, the post might comprise, but is not necessarily limited, to a stem.

The head engaging surfaces 112 of the plurality of spaced-apart resilient posts 110 define together a body contact seat, for instance a head contact seat 114, that is configured to contact (or at least face) at least a section of the human head portion when the helmet 200 is worn. In other words, the head contact seat 114 formed by the head-engaging surfaces 112 of the plurality of spaced-apart resilient posts 110 at least partially defines the head receiving cavity of the helmet 200.

It is to be noted that, even though in the present disclosure, the shock-absorbing assembly 100 is shaped and designed to provide or enhance head protection by being mounted to the outer shell 210 of the helmet 200, the shock-absorbing assembly 100 could also be used to protect any other human body part by being mounted to any other body protection device. For instance the shock-absorbing assembly 100 could be used to provide a knee protection device, an elbow protection device or any other device protecting a part of a body, for instance when practicing football, soccer or any other activity in which a human body part can be shocked. Thus, it is understood that each of the plurality of spaced-apart resilient posts 110 more generally comprises a human body-engaging surface (i.e. not necessarily a head-engaging surface) The human body-engaging surfaces of the plurality of spaced-apart resilient posts 110 define together a body contact seat defining a body contact surface of the body protection device 200 being provided with the shock-absorbing assembly 100. In the following description, the terms referring to a head of a user should thus be understood as referring possibly to any other part of a human body.

In the embodiment shown, the body protection device embodied by the helmet 200 includes an outer shell 210. However, it is appreciated that, in an alternative embodiment, the body protection device could be free of outer shell 210 (or discontinuous) and the shock-absorbing assembly 100 could be exposed outwardly (totally or partially).

Shock-Absorbing Core

A non-limitative embodiment of the shock-absorbing core 102 is described in the PCT application WO2018/072017, the disclosure of which is hereby incorporated by reference in its entirety.

In the embodiment shown, the inner surface 104 of the shock-absorbing core 102 is configured to face at least a section of the human head portion when the helmet 200 is worn.

In the embodiment shown, the shock-absorbing core 102 comprises a plurality of spaced-apart receiving openings 108 defined in the inner surface 104. In an embodiment, the receiving openings 108 communicate with channels extending through the shock-absorbing core 102 and from the inner surface 104 towards the outer surface 106. In the embodiment shown, as represented for instance in FIGS. 1 to 3, FIGS. 21 to 23 or FIGS. 31 to 33, the shock-absorbing core 102 has a 3D internal structure 116 extending between the inner surface 104 and the outer surface 106. The 3D structure 116 includes a plurality of interconnected surfaces which have internal connections with one another, or connections with a portion of one another. In the shown embodiments, the 3D structure 116 is a single piece with the material thereof extending continuously between adjacent and interconnected surfaces. The 3D structure 116 of the shock-absorbing core 102 is embodied, in the non-limitative embodiment shown, by a network of individual cells. As represented for instance in FIGS. 1 to 3, each cell, defined by a respective portion of the interconnected surfaces of the 3D internal structure 116, is open and hollow. The plurality of above-mentioned spaced-apart receiving openings 108 communicates with the empty channels defined between the interconnected surfaces.

In the shown embodiment, the receiving openings 108 have a similar shape, so that the following description of one of the receiving openings 108 will apply to any of them. It could also be conceived a shock-absorbing core 102 having receiving openings 108 with different shapes, dimensions, structure or density. The shock-absorbing core 102 has a thickness T defined between the inner surface 104 and the outer surface 106. The receiving openings 108 extend from the inner surface 104 along a length lo into the shock-absorbing core 102. In some embodiments, the length lo of the receiving openings 108 represents at least about 20% of the thickness T of the shock-absorbing core 102. In some other embodiments, the length lo of the receiving openings 108 represents at least about 40% of the thickness T of the shock-absorbing core 102. In yet some other embodiments, the length lo of the receiving openings 108 represents at least about 50% of the thickness T of the shock-absorbing core 102. In yet some other embodiments, the length lo of the receiving openings 108 represents at least about 60% of the thickness T of the shock-absorbing core 102. In yet some other embodiments, each one of the receiving openings 108 extends substantially from the inner surface 104 to the outer surface 106.

In the shown embodiment, each one of the receiving openings 108 opens on the inner surface 104 of the shock-absorbing core 102 so as to form an inner port 118. In the embodiment shown, the inner port 118 is substantially circular. In the embodiment in which the receiving opening 108 extends substantially from the inner surface 104 to the outer surface 106, the receiving opening 108 opens on the outer surface 106 of the shock-absorbing core 102 so as to form an outer port 119. In some embodiments, the outer port 119 is substantially circular. In some embodiments, the outer port 119 and the inner port 118 have substantially similar dimensions and/or shapes and/or configuration and/or density.

The 3D internal structure 116 of the shock-absorbing core 102 is further dimensioned so as to form blocking areas 117 in the receiving opening 108. In the shown embodiment, the cross-section area of the receiving opening 108 varies along a direction of the receiving opening 108 substantially parallel to the direction of the thickness T of the shock-absorbing core 102, i.e. substantially normal to at least one of the inner surface 104 of the absorbing core 102 and the outer shell 210.

In one embodiment, the shock-absorbing core 102 is made at least partially from a 3D-printed material and, more particularly, a 3D-printed plastic.

Figure 29:
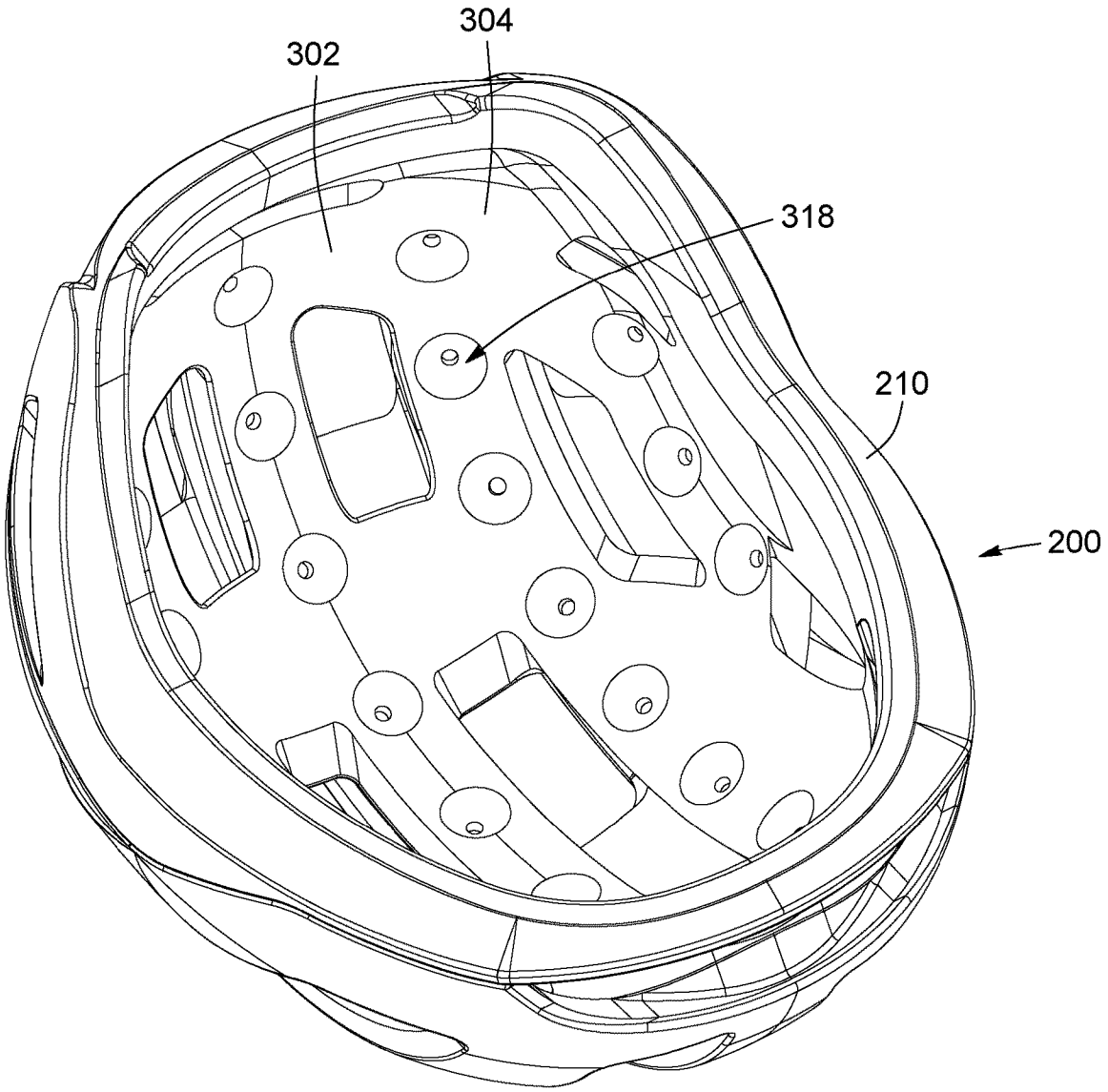
FIG. 29 is a bottom perspective view of a helmet in accordance with another embodiment.
Figure 30:
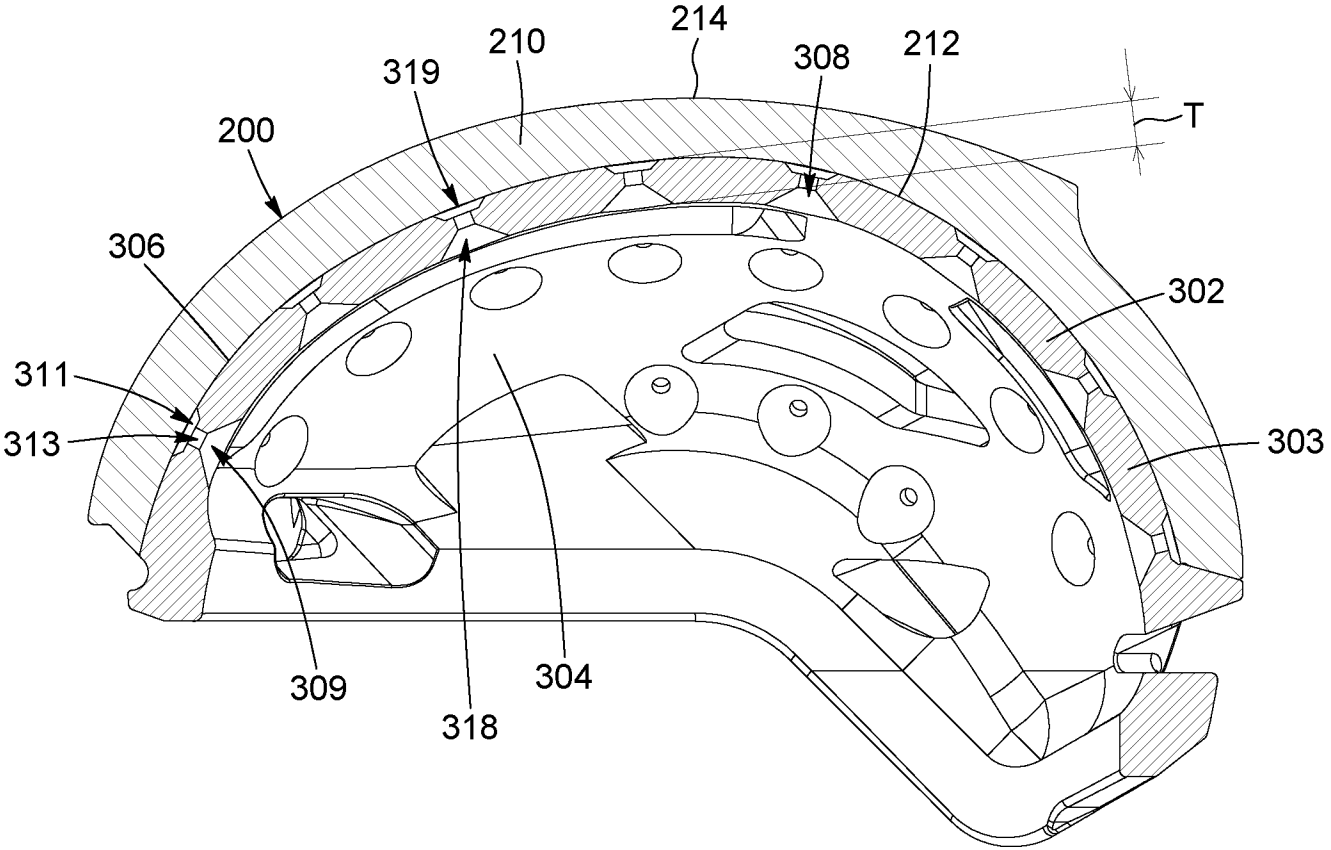
FIG. 30 is a cross-section view of the helmet of FIG. 29.

FIGS. 29 and 30 represent another possible embodiment of a shock-absorbing core 302. In the embodiment shown, and contrary to the embodiment described above, the shock-absorbing core 302 does not have a 3D internal structure. In the embodiment shown, the shock-absorbing core 302 has a core body 303 and comprises an inner surface 304 and an outer surface 306. For instance, the core body 303 is at least partially made of foam. A plurality of spaced-apart receiving openings 308 are formed in the shock-absorbing core 302 and open in the inner surface 304 so as to form inner ports 318. In the embodiment shown, the receiving openings 308 also open in the outer surface 306 so as to form outer ports 319. In the embodiment shown, the cross-section area of the receiving openings 308 varies along a direction of the receiving openings 308 substantially parallel to the direction of the thickness T of the shock-absorbing core 302, i.e. substantially normal to at least one of the inner surface 304 of the absorbing core 302 and the outer shell 210 of the helmet 200.

In the embodiment shown, each of the plurality of receiving openings 308 has an inner portion 309 with a substantially truncated shape, the inner portion 309 having a cross-section area diverging towards the inner surface 304 and opening in the inner surface 304 at the inner port 318. Each of the receiving openings 308 also comprises an outer portion 311 opening in the outer surface 306 at the outer port 319. The inner portion 309 and the outer portion 311 are separated by a neck (or a central portion) 313. For instance, the neck 313 has a substantially cylindrical shape and a cross-section area of the neck 313 is smaller than a cross-section area of the outer portion 311. The cross-section area of the neck 313 is also smaller than a cross-section area of the inner port 318 formed in the inner surface 304 by the inner portion 309.

It is appreciated that the shape and the configuration of the shock-absorbing cores 102, 302, the shape, the configuration, the location, and the density of the receiving openings 108, 308, as well as the shape, the configuration, the location and the density of the inner ports 118, 318 and the outer ports 119, 319 can vary from the embodiments shown.

Resilient Posts

In the embodiment shown in FIGS. 1 to 9, 15 and 16, the spaced-apart resilient posts 110 have a similar shape, so that the following description of one of the spaced-apart resilient posts 110 will apply to any of them. It could also be conceived a shock-absorbing assembly 100 having spaced-apart resilient posts 110 having different shapes, dimensions, structure, arrangement or density with regards to the shock-absorbing core 102.

As represented in FIGS. 5 to 9, the resilient post 110 has a body 120 comprising a stem 122 and a body contact base, for instance a head contact base 124, extending from the stem 122.

Figure 7:
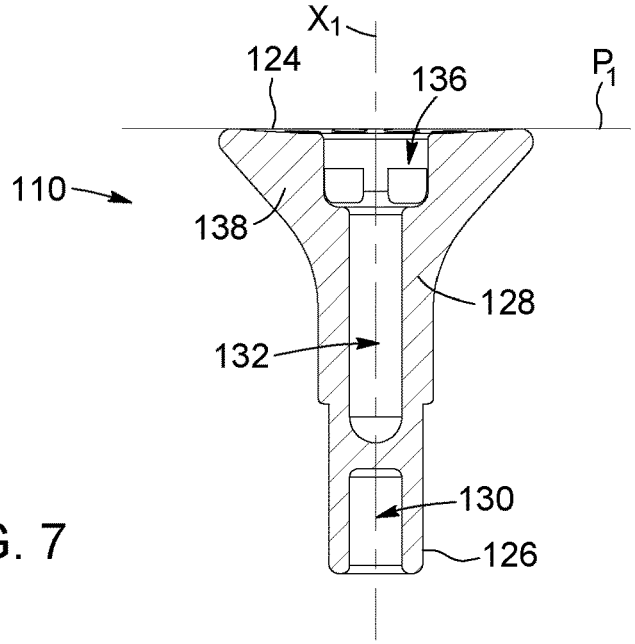
FIG. 7 is a cross-section view of the resilient post of FIG. 5 along cross-section lines B-B of FIG. 6.
Figure 8:
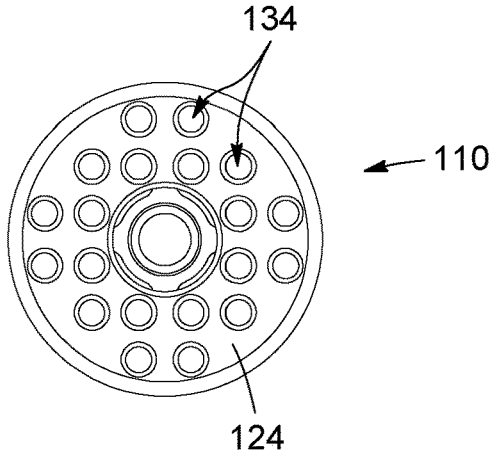
FIG. 8 is a top elevation view of the resilient post of FIG. 5.
Figure 9:
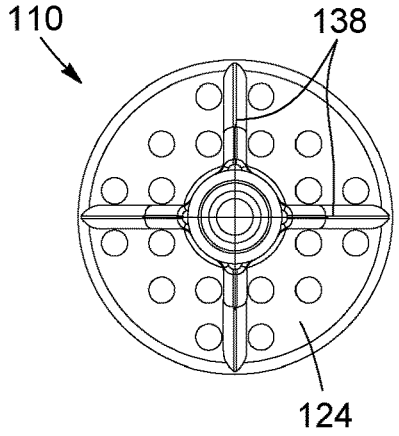
FIG. 9 is a bottom elevation view of the resilient post of FIG. 5.
Figure 10:
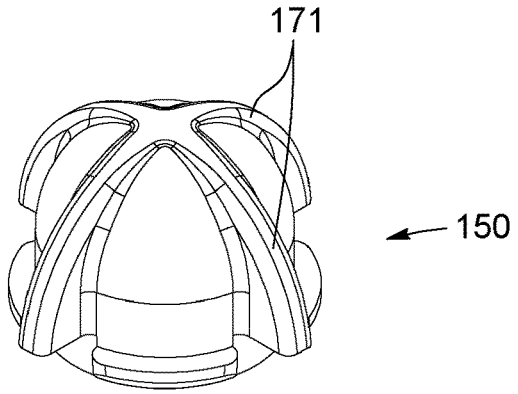
FIG. 10 is a perspective view of one of the resilient pads of the portion of the helmet of FIG. 1.
Figure 11:
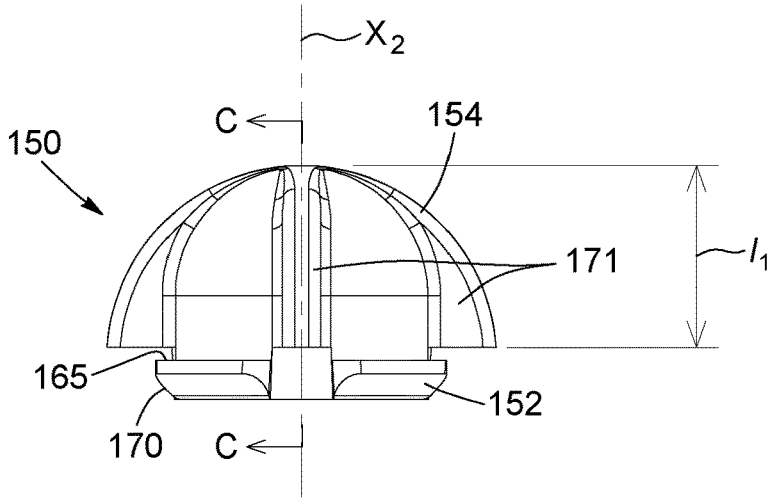
FIG. 11 is a side elevational view of the resilient pad of FIG. 10.
Figure 12:
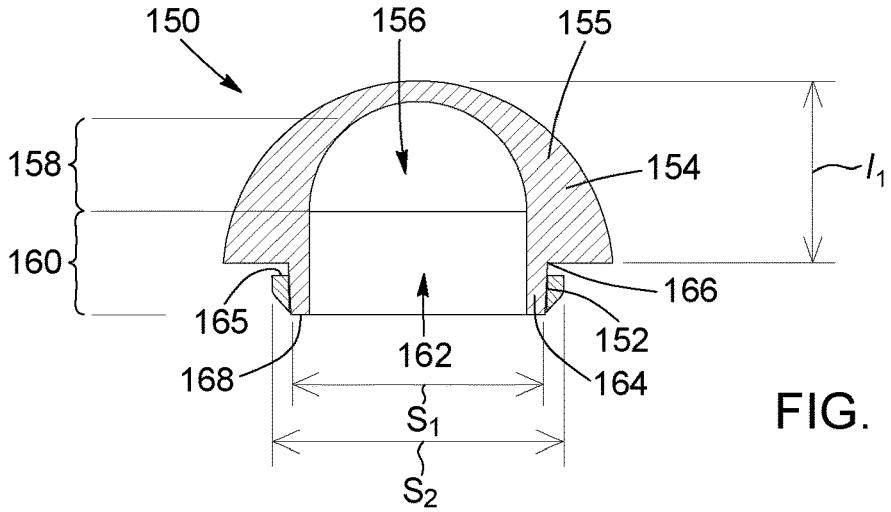
FIG. 12 is a cross-section view of the resilient pad of FIG. 10 along cross-section lines C-C of FIG. 11.
Figure 13:
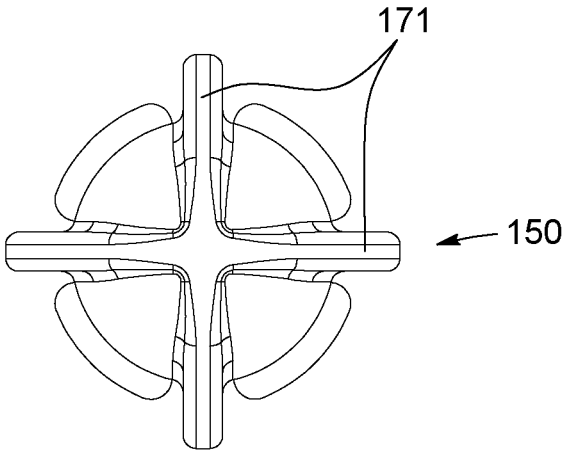
FIG. 13 is a top elevational view of the resilient pad of FIG. 10.
Figure 14:
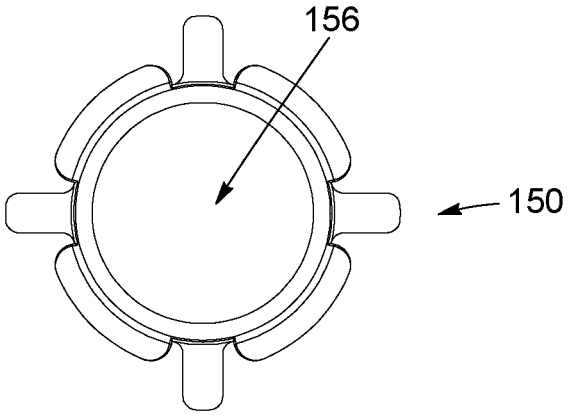
FIG. 14 is a bottom elevational view of the resilient pad of FIG. 10.

The stem 122 has a core engaging end 126 engageable with the shock-absorbing core 102, and an opposed outer end 128 from which the head contact base 124 extends. In the embodiment shown, the stem 122 is substantially cylindrical and defines a first axis X1. The stem 122 might be at least partially hollow, as represented in FIG. 7, and might comprise a first inner cavity 130 opening in the core engaging end 126, and a second inner cavity 132 extending towards the head contact base 124. In the shown embodiment, the first and second inner cavities 130, 132 are substantially cylindrical with a substantially similar diameter and with axes that are both aligned substantially with the first axis X1 of the stem 122.

Figure 20:
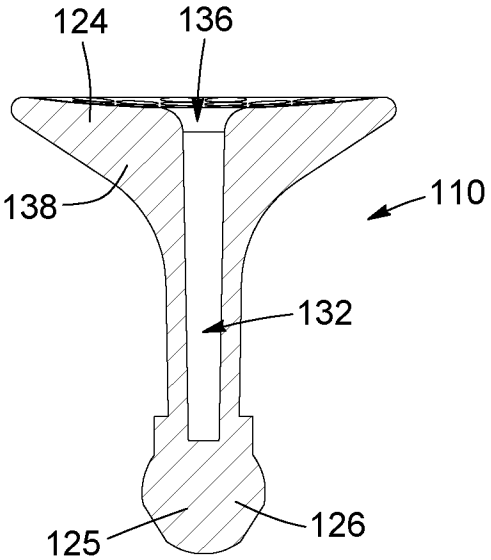
FIG. 20 is a cross-section view of the resilient post of FIG. 18 along cross-section lines D-D of FIG. 18.
Figure 19:
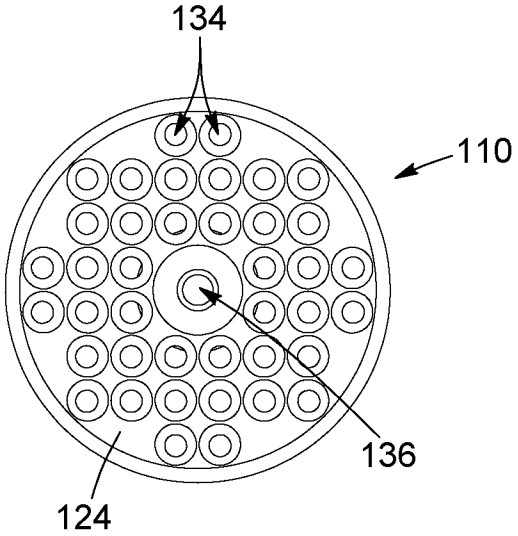
FIG. 19 is a top elevational view of the resilient post of FIG. 18.
Figure 18:
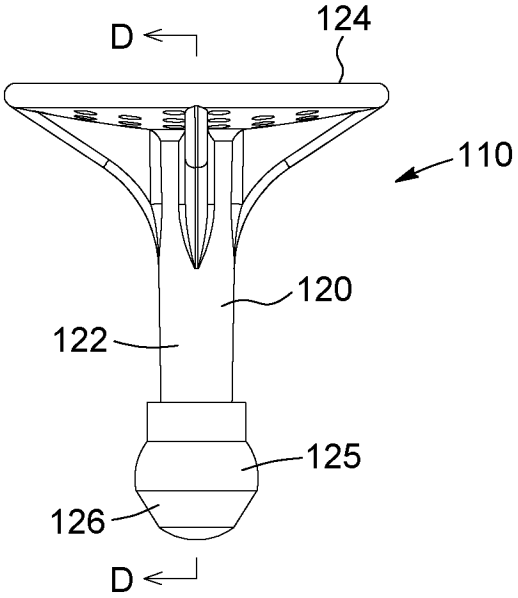
FIG. 18 is a side elevational view of a resilient post in accordance with another embodiment.

As represented in the embodiment of FIGS. 18 to 20, the spaced-apart resilient post 110 might further comprise a blocking head 125 formed at the core engaging end 126 of the stem 122, the purpose of which will be described in more details below.

The head contact base 124 defines the head engaging surface 112 of the resilient post 110. In the embodiment shown, the head engaging surface 112 of the head contact base 124 is substantially circular. A plurality of through openings 134 are formed in the head contact base 124 and extend inwardly from the head engaging surface 112. Moreover, the head engaging surface 112 extends in a head engaging plane P1, the head engaging plane P1 being transversal to the first axis X1 of the stem 122. In the shown embodiment, the head engaging plane P1 is substantially perpendicular to the first axis X1 of the stem 122.

A central aperture 136 is further formed in the head contact base 124. In the embodiment shown, the central aperture 136 is substantially circular and communicates with the second inner cavity 132 formed in the stem 122, i.e. the central aperture 136 defines a continuous channel with the second inner cavity 132 that extends through the resilient post 110.

It should be understood that the central aperture 136 and the through aeration openings 134 allow the increase of the surface of the head engaging surface 112 without increasing the weight of the deformable resilient post 110. Moreover, thanks to the central aperture 136 and the through aeration openings 134, the risk of occurrence of a suction effect on the head of the user when the helmet is worn is limited. In other words, the central aperture 136 and the through aeration openings 134 contribute to the comfort of the user wearing the helmet 200 for ventilation purpose.

The resilient post 110 further comprises reinforcing ribs 138 extending along a portion of an outer surface of the stem 122 and connected to the head contact base 124. In the embodiment shown, each resilient post 110 includes four reinforcing ribs 138, with an angle of 90 degrees being formed between two adjacent reinforcing ribs 138.

In the embodiment shown, the resilient post 110 is made of a single element. The resilient post 110 has a length L corresponding substantially to a length of the stem 122 considered along the first axis X1, i.e. the head contact base 124 being thin in comparison with the length of the stem 122. The resilient post 110 also has a width W corresponding substantially to a diameter of the head contact base 124. In some embodiments, the width W of the resilient post 110 represents at least about 10% of its length L. In some other embodiments, the width W of the resilient post 110 represents at least about 25% of its length L. In yet some other embodiments, the width W of the resilient post 110 represents at least about 40% of its length L.

In some embodiments, the resilient post 110 is at least partially made of injection molded plastic. In some other embodiments, the resilient post 110 could at least partially be made from a 3D-printed material and, more particularly, 3D-printed plastics.

In some embodiments, the resilient post 110 is at least partially deformable and has elastic/resilient properties. In some embodiments, the resilient post 110 is made from a material being more deformable and/or more elastic/resilient/flexible than the material from which the shock-absorbing core 102 is made. For instance and without being limitative, the resilient posts 110 are at least partially made of thermoplastic polyurethane (TPU). In some other embodiments, at least some of the resilient posts 110 might be made integral with the shock-absorbing core 102. In some embodiments, the shock-absorbing core 102 is at least partially made of TPU.

Shock-Absorbing Assembly

The shock-absorbing assembly 100 includes the plurality of the resilient posts 110 that are configured to be mounted to the shock-absorbing core 102, in a spaced-apart configuration, and to protrude inwardly from the shock-absorbing core 102. In the embodiment shown, the stem 122 of the resilient post 110 is dimensioned so as to be introduced in one of the spaced-apart receiving openings 108 formed in the shock-absorbing core 102. In the embodiment in which the resilient post 110 comprises the blocking pin 125 (or blocking head 125), represented in FIGS. 18 to 20, the blocking pin 125 is dimensioned and designed to cooperate with the shock-absorbing core 102 so as to prevent—or at least limit—the removal of the resilient post 110 out from the corresponding receiving opening 108 of the shock-absorbing core 102. In the embodiment shown, the blocking pin 125 is substantially spherical. In some other embodiments, the blocking pin 125 is tapered, such as mushroom shaped, in a direction opposed to the head contact base 124, so that the resilient post 110 can easily be introduced in the corresponding receiving opening 108 and so that the removal of the resilient post 110 from the corresponding opening 108 is further limited. For instance, the 3D structure of the shock-absorbing core 102 forms, in the receiving opening 108, an abutting portion against which the blocking pin 125 abuts when a force is exerted on the resilient post 110 in a direction opposed to the outer surface 106 of the shock-absorbing core 102. In the embodiment of the shock-absorbing core 302 represented in FIGS. 29 and 30 in which the receiving openings 308 comprise the inner portion 309, the neck (or central portion) 313 and the outer portion 311, the abutting portion is formed at a junction between the outer portion 311 and the neck 313: the outer portion 311 is shaped and designed to receive the blocking pin 125 of the resilient post 110 and the neck 313 is shaped and designed to receive at least partially the stem 122 of the resilient post 110 while limiting the risk that the blocking pin 125 be removed out of the outer portion 311.

When the resilient post 110 is mounted to the shock-absorbing core 102, the resilient post 110 has a portion 140 protruding from the inner surface 104, i.e. outwardly from the shock-absorbing core 102. In other words, the portion 140 of the resilient post 110 extends inwardly with respect to the head receiving cavity of the helmet 200 (i.e. the protruding portion 140 substantially extends in the head receiving cavity of the helmet 200), but extend outwardly with respect to the 3D internal structure 116 of the shock-absorbing core 102 (or outwardly with respect to the core body 303 of the shock-absorbing core 302). The head contact base 124 thus extends at a spacer distance d1 from the inner surface 104 of the shock-absorbing core 102. It is understood that the spacer distance d1 corresponds substantially to a length of the portion 140 protruding inwardly (with respect to the head receiving cavity of the helmet 200), considered along the first axis X1 of the stem 122. In some embodiments, the spacer distance d1 represents at least about 10% of the length L of the resilient post 110. In some other embodiments, the spacer distance d1 represents at least about 20% of the length L of the resilient post 110. In yet some other embodiments, the spacer distance d1 represents at least about 25% of the length L of the resilient post 110. In yet some other embodiments, the spacer distance d1 represents at least about 40% of the length L of the resilient post 110. In yet some other embodiments, the spacer distance d1 represents at least about 50% of the length L of the resilient post 110. In yet some other embodiments, the spacer distance d1 represents at least about 60% of the length L of the resilient post 110. In other words, when the resilient posts 110 are mounted to the shock-absorbing core 102, the head engaging surface 112 is spaced apart from the inner surface 104 of the shock-absorbing core 102. The portion 140 of the resilient post 110 protruding outwardly includes the head contact base 124 and a section of the stem 122.

In some embodiments, the spacer distance d1 is greater than at least about 10% of the thickness T of the shock-absorbing core 102. In some other embodiments, the spacer distance d1 is greater than at least about 30% of the thickness T of the shock-absorbing core 102. In some other embodiments, the spacer distance d1 is greater than at least about 40% of the thickness T of the shock-absorbing core 102. In some other embodiments, the spacer distance d1 is greater than at least about 50% of the thickness T of the shock-absorbing core 102. In yet some other embodiments, the spacer distance d1 is greater than at least about 60% of the thickness T of the shock-absorbing core 102.

The portion of the resilient post 110 introduced in the shock-absorbing core 102 (i.e. the core-engaging portion 141 of the resilient post 110) has a length d2, considered along the first axis X1 of the stem 122. In some embodiments, the length d2 of the core-engaging portion 141 of the resilient post 110 received in one of the receiving openings 108 represents about 10% of the thickness T of the shock-absorbing core 102. In some other embodiments, the length d2 of the core-engaging portion 141 of the resilient post 110 received in one of the receiving openings 108 represents about 30% of the thickness T of the shock-absorbing core 102. In yet some other embodiments, the length d2 of the core-engaging portion 141 of the resilient post 110 received in one of the receiving openings 108 represents about 50% of the thickness T of the shock-absorbing core 102. It is thus understood that the length d2 is not null, so as to ensure a firm connection of the resilient post 110 to the shock-absorbing core 102. Furthermore, by having the connection between the resilient post 110 and the shock absorbing core 102 recessed within the shock absorbing core 102, the length of the resilient post 110 can be increased without increasing compulsorily the spacer distance d1.

In the embodiment shown, the resilient post 110 is mounted to the shock-absorbing core 102 so that the plane P1 defined by the head contact base 124 extends substantially parallel to a tangential plane defined at the intersection between the inner surface 104 of the shock-absorbing core 102 and the stem 122 of the resilient post 110. In other words, in the embodiment shown, the stem 122 of the resilient post 110 extends substantially perpendicular to the area of the inner surface 104 in which is formed the inner port 118 of the corresponding receiving opening 108.

In the embodiment shown, the plurality of spaced-apart resilient posts 110 are arranged so that their head contact bases 124 all extend at a substantially identical spacer distance d1 from the inner surface 104 of the shock-absorbing core 102. In the embodiment shown, the head engaging surface 112 of the head contact bases 124 of the plurality of resilient posts 110 define together a discontinuous surface, forming the above-mentioned head contact seat 114. The surface of the head contact seat 114 extends substantially parallel to the inner surface 104 of the shock-absorbing core 102.

Figure 4:
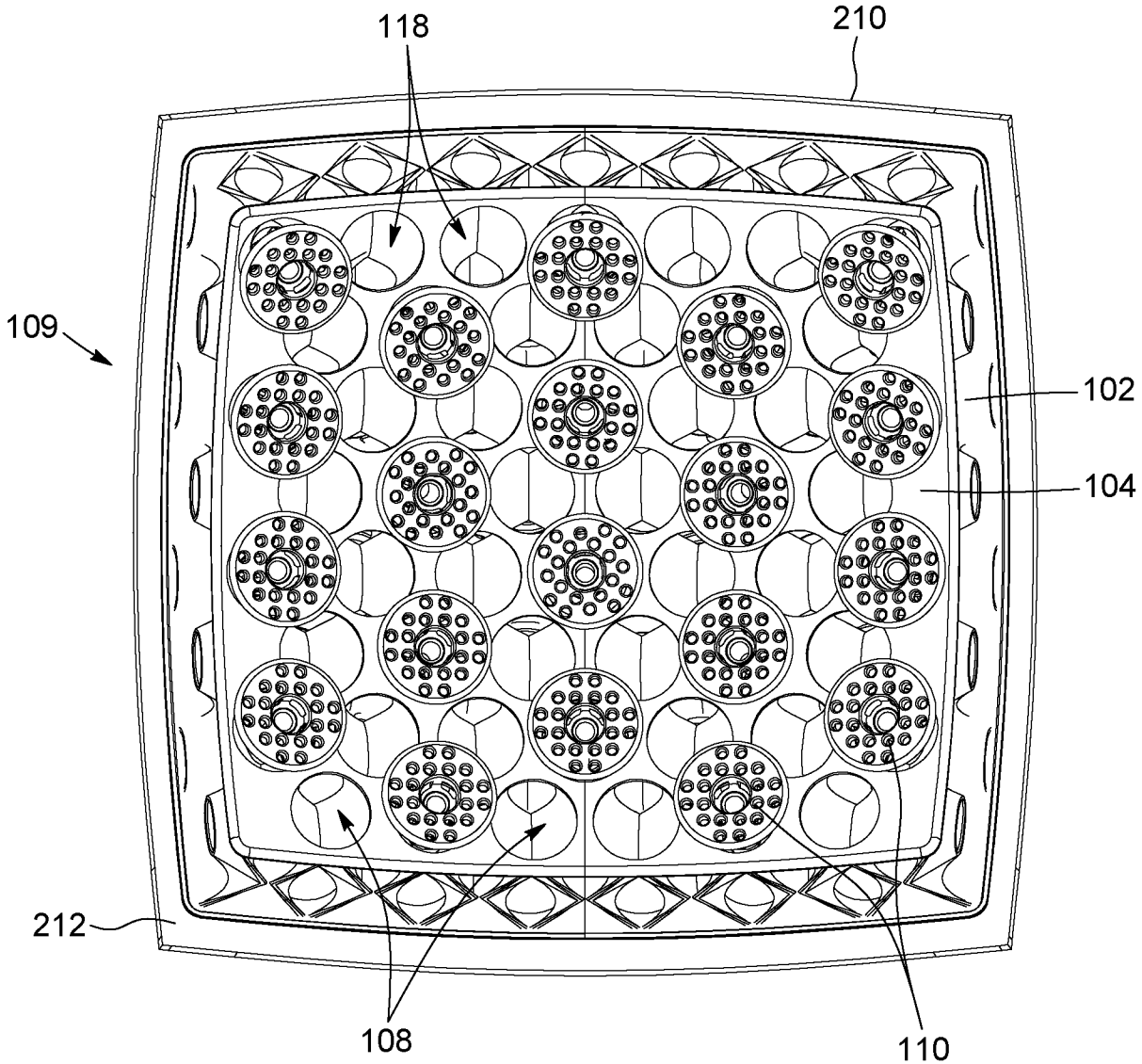
FIG. 4 is a bottom plan view of the portion of the helmet of FIG. 1.
Figure 5:
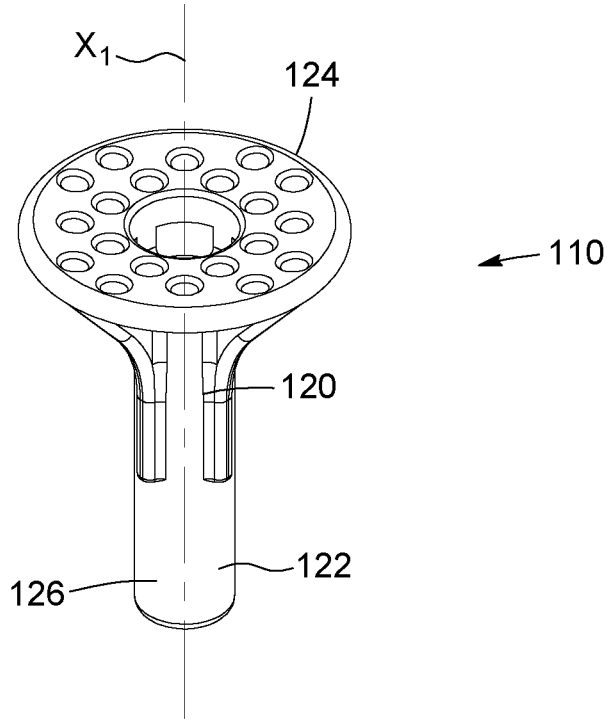
FIG. 5 is a top perspective view of one of the resilient posts of the portion of the helmet of FIG. 1.
Figure 6:
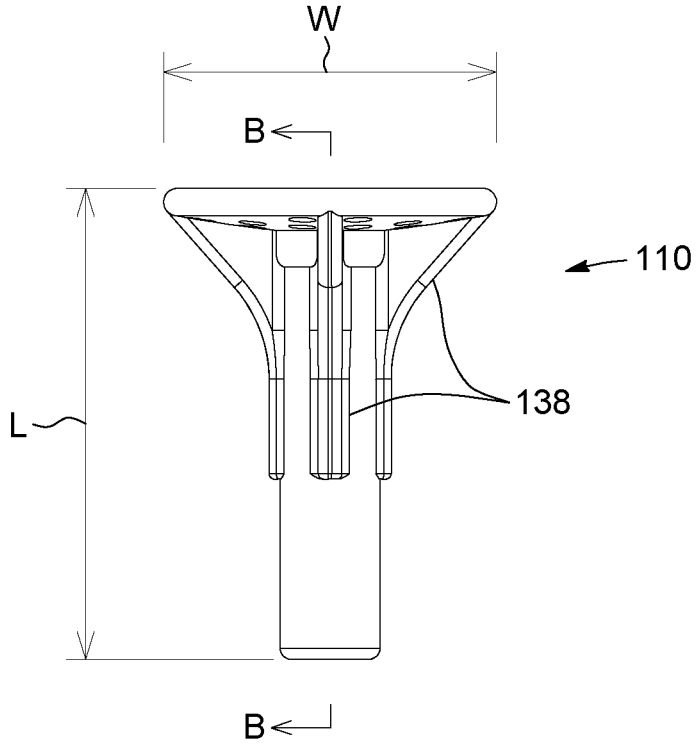
FIG. 6 is a side elevational view of the resilient post of FIG. 5.

As represented in FIG. 4, the spaced-apart resilient posts 110 might be arranged so that their head contact bases 124 are spaced apart from each other. In some other embodiments, the spaced-apart resilient posts 110 could be arranged so that their head contact bases 124 are closer to each other and even contact the adjacent head contact bases 124. In yet some other embodiments, the spaced-apart resilient posts 110 could be arranged so that at least some of their head contact bases 124 at least partially cover some other head contact bases 124. In some embodiments, the area of the head contact seat 114 represents at least about 15% of the area of the inner surface 104. In some other embodiments, the area of the head contact seat 114 represents at least about 25% of the area of the inner surface 104. In yet some other embodiments, the area of the head contact seat 114 represents at least about 40% of the area of the inner surface 104. In yet some other embodiments, the area of the head contact seat 114 represents at least about 60% of the area of the inner surface 104. In yet some other embodiments, the area of the head contact seat 114 represents at least about 80% of the area of the inner surface 104.

Figure 31:
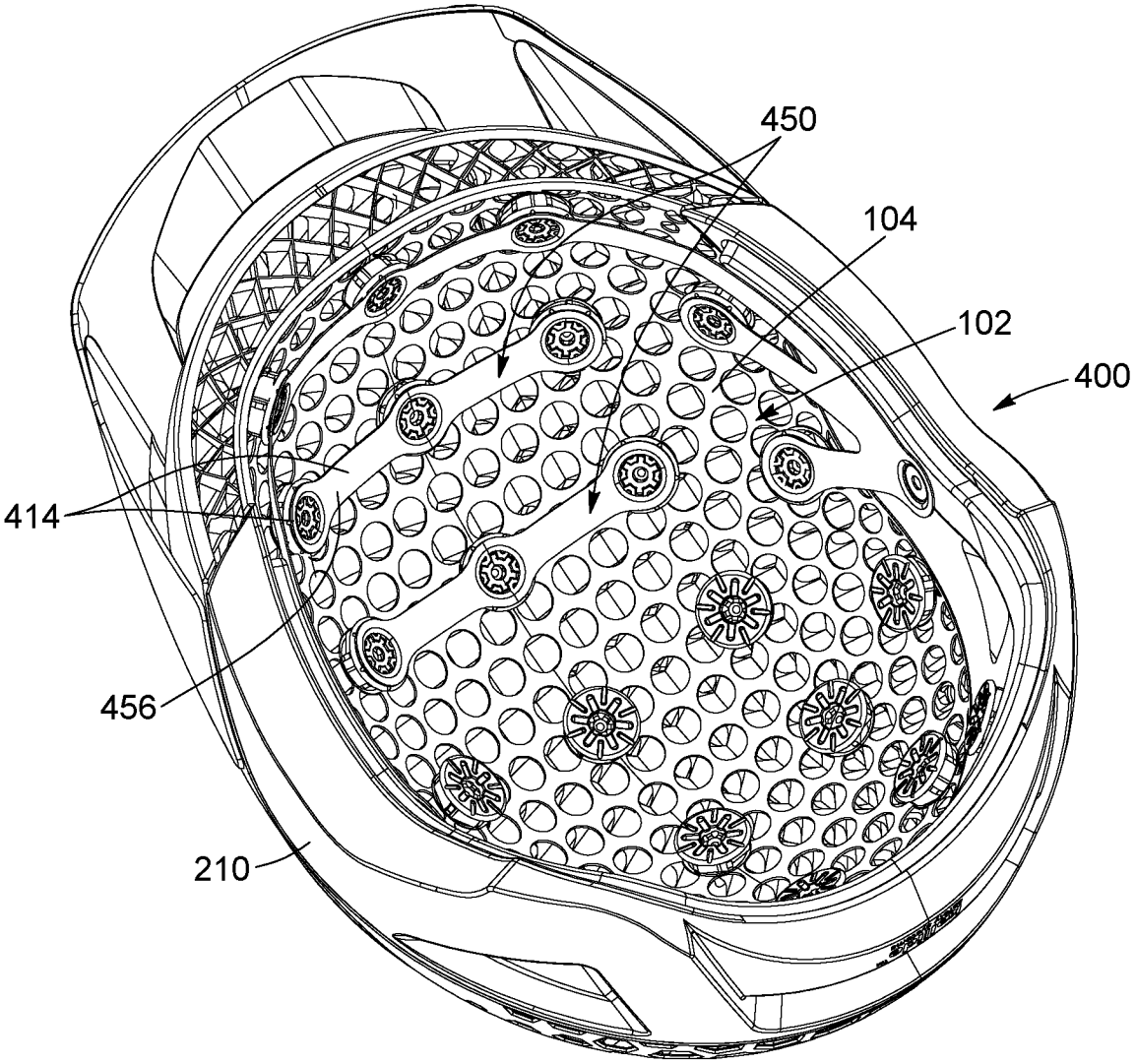
FIG. 31 is a bottom perspective view of a helmet in accordance with another embodiment.
Figure 32:
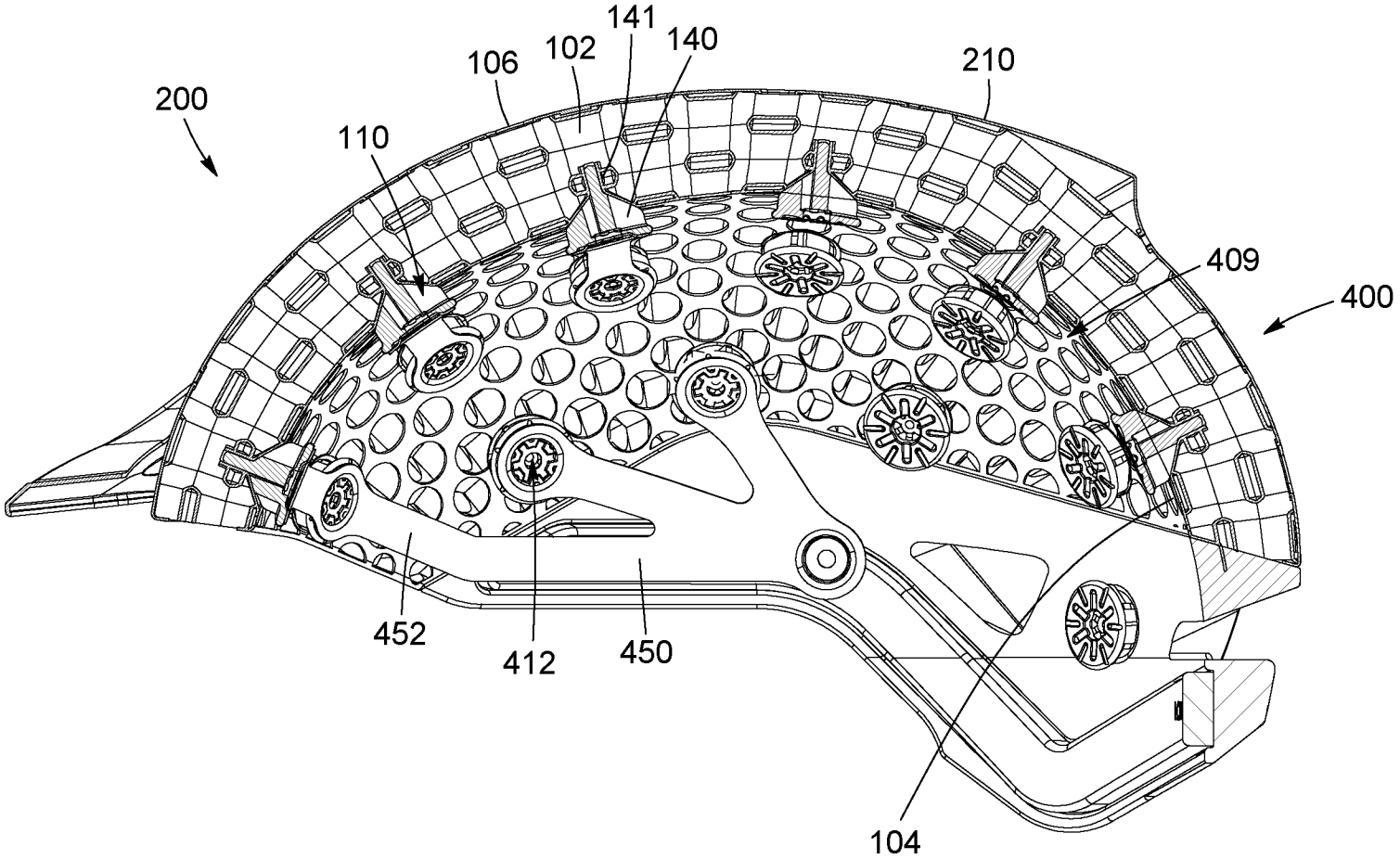
FIG. 32 is a cross-section view of the helmet of FIG. 31.
Figure 33:
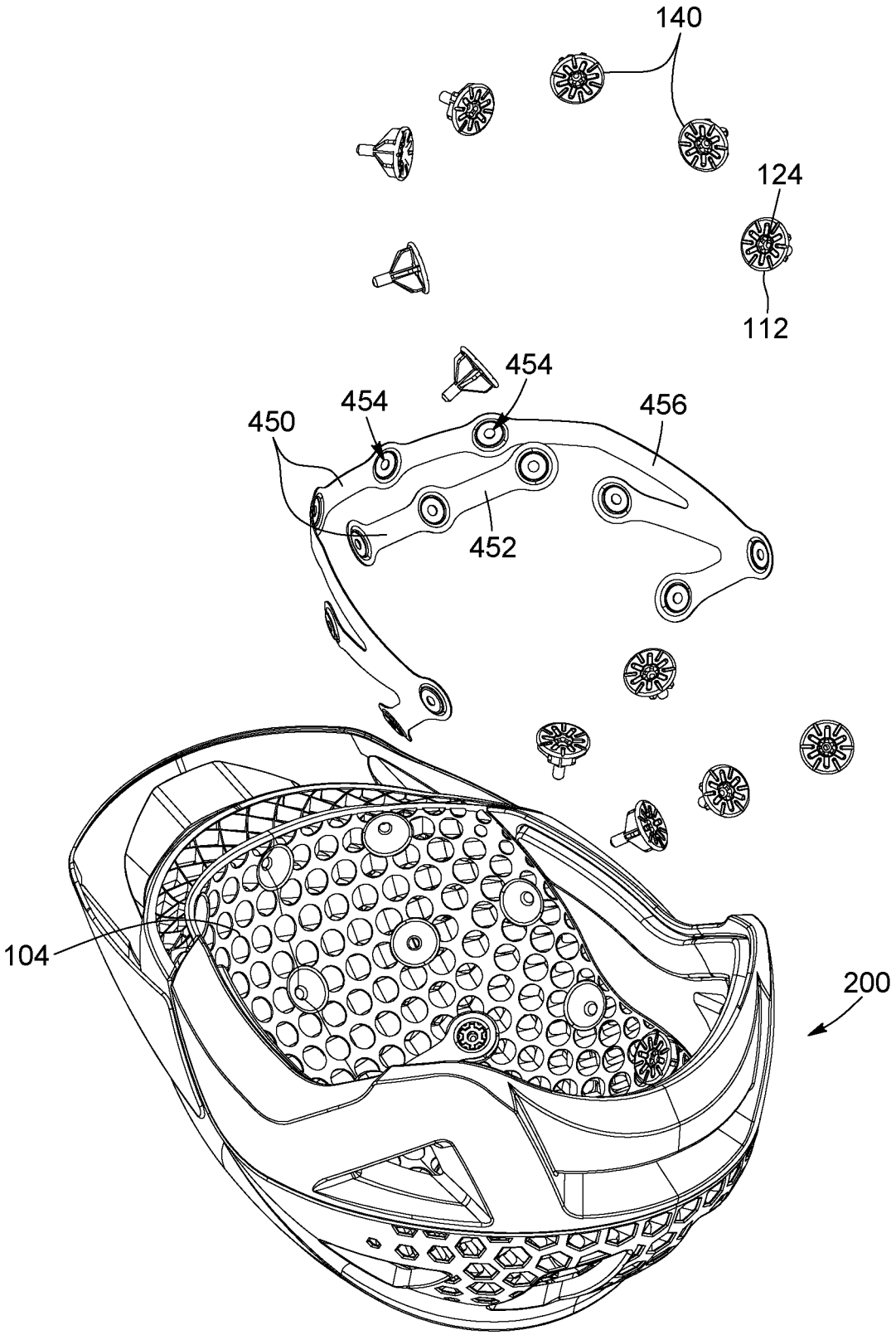
FIG. 33 is a bottom perspective view, partially exploded, of the helmet of FIG. 31.

As represented in FIGS. 31 to 33, in another embodiment, the body contact seat assembly 409 of the shock-absorbing assembly 400 could further comprise body-engaging straps, for instance head-engaging straps 450 configured to couple together the body contact base 424 (or head contact base 424) of at least some of the plurality of spaced-apart resilient posts 110. For instance, the head-engaging strap 450 comprises linking segment(s) 452 and a plurality of post connectors 454. Amongst others, the linking segments 452 extend between two adjacent and consecutive post connectors 454. Each one of the post connectors 454 is securable to the protruding portions 140 of the resilient posts 110, securable to the body contact base 124 in the embodiment shown. Moreover, the head-engaging straps 450 are configured to increase a surface area of the head contact seat 414: in the embodiment shown, the head contact seat 414 comprises the head-engaging surfaces 112 of the resilient posts 410 and an inner surface 456 of the head-engaging straps 450. As represented in FIG. 33, the head-engaging straps 450 are shaped and designed to be in contact with specific areas of the head of the user (for instance with the front head of the user, in the embodiment shown). For instance and without being limitative, the head-engaging straps 450 are at least partially made of TPU. For comfort purposes, the head-engaging straps 450 are at least partially made from a material being more deformable and/or more elastic/resilient/flexible than the material from which the shock-absorbing core 102 is made.

In some implementations, the body engaging straps 450 can be or can support sweatbands and/or cushioning/padding bands or straps. For instance, padding bands can be detachably mounted to the body engaging straps 450 for sweat absorption and cushioning.

It could also be conceived a head-engaging strap 450 that would be couplable to the shock-absorbing core 102 via the connected resilient posts 110: the stem 122 of the resilient posts 110 could be introduced into post-receiving apertures formed in the head-engaging strap 450 for the head-engaging strap 450 to be at least partially sandwiched between the body contact base 124 of the resilient posts 110 and the inner surface 104 of the shock-absorbing core 102, once the core-engaging portions 441 would be engaged into the receiving openings 108 of the shock-absorbing core 102. In other words, the resilient posts 110 could form mechanical fasteners configured to fasten the head-engaging straps 450 to the inner surface 104 of the shock-absorbing core 102.

It is appreciated that the shape, the number, the configuration and the location of the head-engaging straps 450 with regards to the shock-absorbing core 102 and to the helmet 200, as well as the configuration of the cooperation between the resilient posts 110 and the head-engaging straps 450 can vary from the embodiment shown.

It is appreciated that the shape, the configuration, the structure, the location and the density of the spaced-apart resilient posts 110 with regards to the shock-absorbing core 102 can vary from the embodiment shown.

In the embodiment shown, all the spaced-apart resilient posts 110 have the same dimensions, the same shape and the same arrangement with regards to the shock-absorbing core 102. In some implementations, the shape, configuration and/or mechanical properties of the spaced-apart resilient posts 110 can vary in accordance with their location on the absorbing core 102 of the helmet 200. It could also be conceived a shock-absorbing assembly 100, 400 in which the spaced-apart resilient posts 110, 410 would have head contact bases 124 with complimentary shapes so as to define a head contact seat 114, 414 having a substantially continuous surface.

Figure 21:
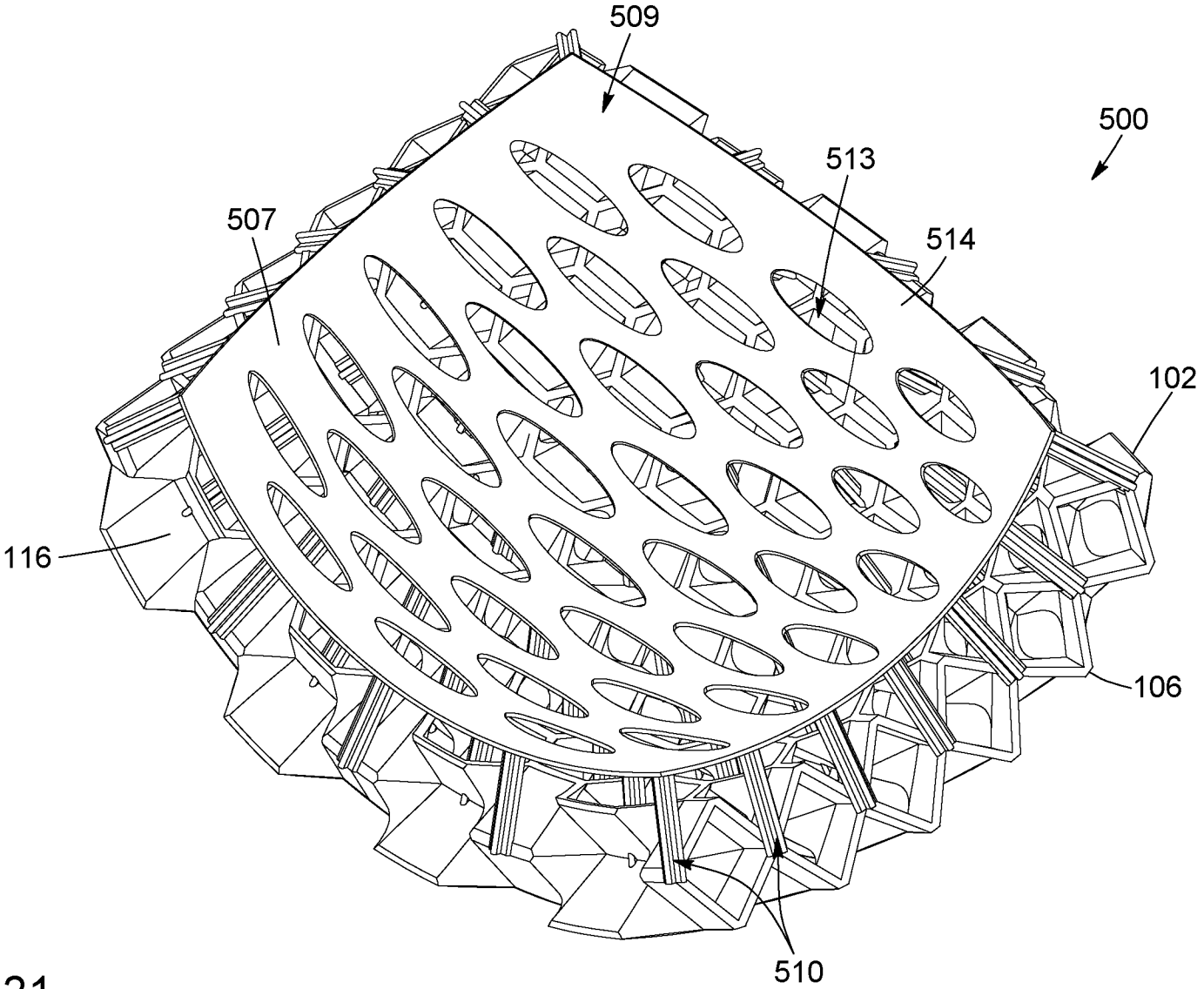
FIG. 21 is a bottom perspective view of a shock-absorbing assembly in accordance with another embodiment.
Figure 22:
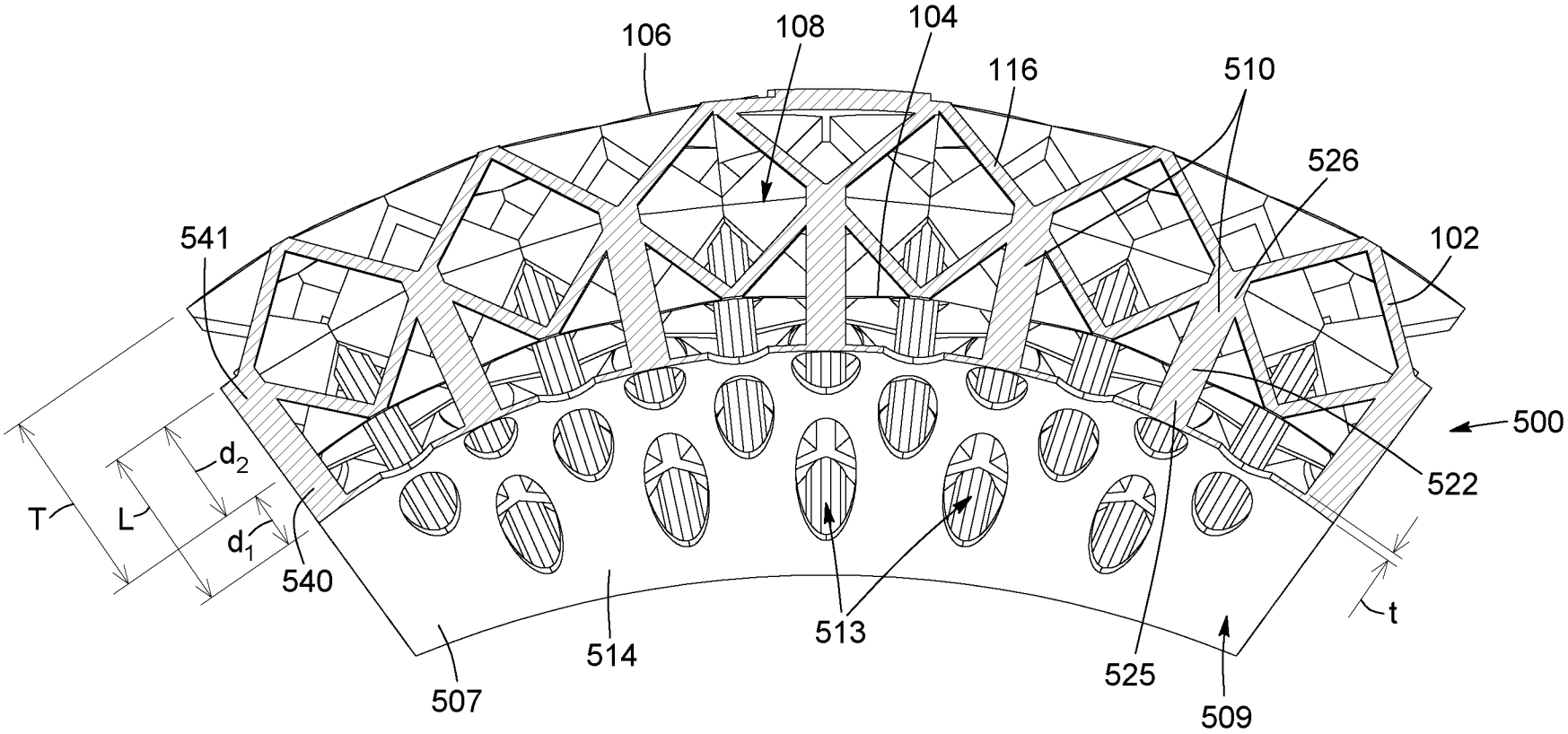
FIG. 22 is a cross-section view of the shock-absorbing assembly of FIG. 21.
Figure 23:
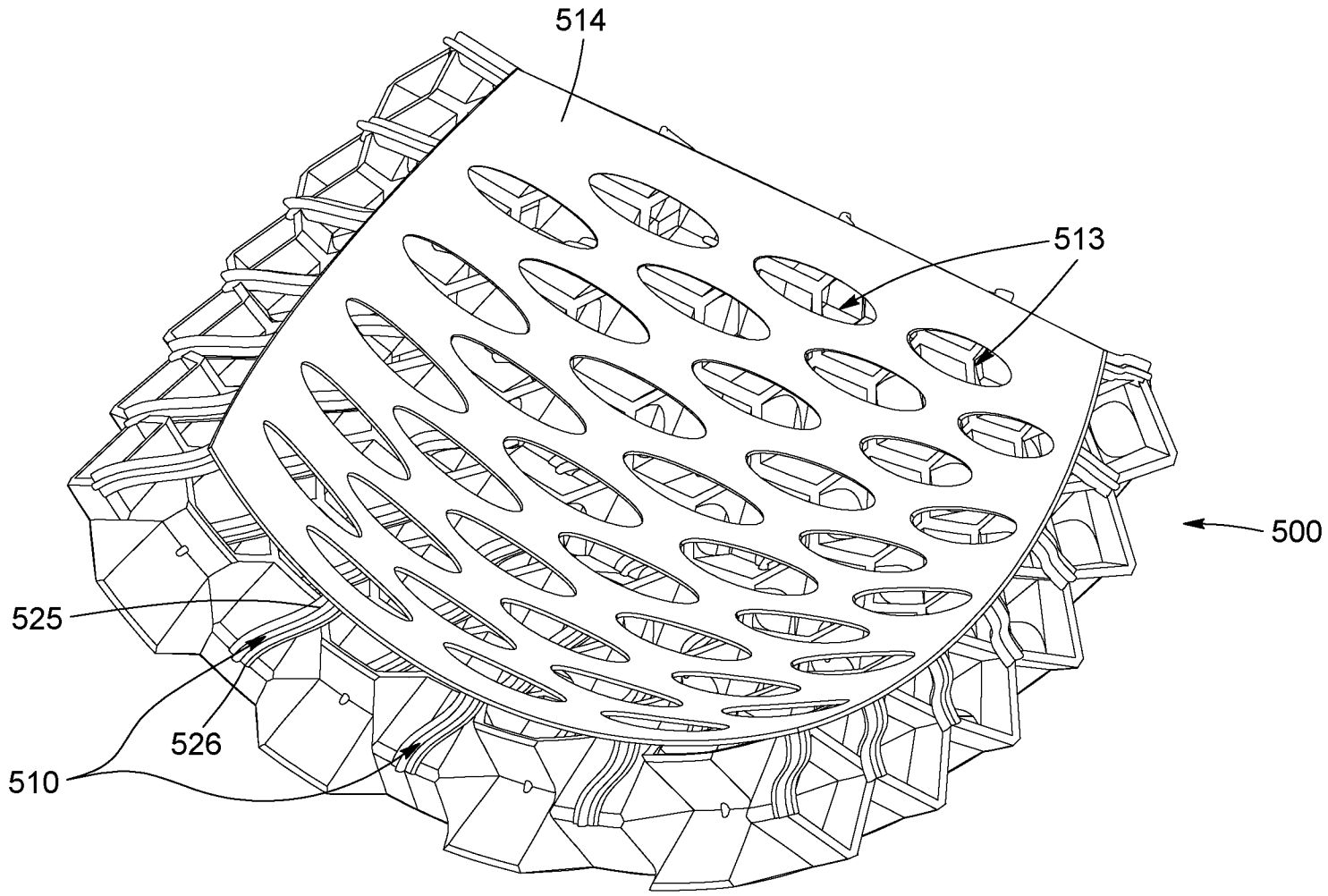
FIG. 23 is a bottom perspective view of the shock-absorbing assembly of FIG. 22, the assembly being configured in a stressed configuration.

FIGS. 21 to 23 represent another possible embodiment of a shock-absorbing assembly 500. The shock-absorbing assembly 500 comprises a shock-absorbing core 102—for instance comprising a 3D-structure—and a body contact seat assembly—for instance a head contact seat assembly 509, in the embodiment shown.

The head contact seat assembly 509 comprises a plurality of spaced-apart resilient posts 510 secured to the shock-absorbing core 102. Each resilient post 510 has a portion 540 protruding from the inner surface 104 of the shock-absorbing core 102. The head contact seat assembly 509 further comprises a body contact seat—for instance a head contact seat 514 mounted to the shock-absorbing core 102 via the protruding portion 540 of the plurality of resilient posts 510 (i.e. the head contact seat 514 comprises a contact seat layer 507 supported by the resilient posts 510), so that the head contact seat 514 is in spaced relationship with the shock-absorbing core 102 and is at least one of slidable, displaceable, shearable, and twistable with respect to the inner surface 104 of the shock-absorbing core 102. In other words, each resilient post 510 comprises an outer end 525 spaced-apart from the inner surface 104 of the shock-absorbing core 102 when the resilient post 510 is secured thereto and the head contact seat 514 is arranged at the outer ends 525 of the resilient posts 510 to be at least one of slidable, displaceable, shearable, and twistable with respect to the inner surface 104 of the shock-absorbing core 102.

Similarly to the above-described embodiments, each resilient post 510 comprises a stem 522 extending at least partially in one of the receiving openings 108 formed in the shock-absorbing core 102. The stem 522 comprises the outer end 525 (or seat-mounting end 525) and an opposed core-engaging end 526 engageable with the shock-absorbing core 102. In the embodiment shown, the core-engaging end 526 is formed integral with the 3D internal structure 116 of the shock-absorbing core 102, as represented in FIG. 22. The engagement of the resilient posts 510 with the shock-absorbing core 102 is not limited to the embodiment shown: it could be conceived resilient posts that would not be formed integral with a portion of the shock-absorbing core 102. For instance, the resilient posts could comprise a blocking pin or a blocking head dimensioned and designed to cooperate with the shock-absorbing core 102 so as to prevent—or at least limit—the removal of the resilient posts 510 out from the corresponding receiving opening 108 of the shock-absorbing core 102. The core-engaging end 526 could also be glued or welded to a portion of the internal structure of the shock-absorbing core 102.

Similarly to the head-contact base 124 of the embodiment of the shock-absorbing assembly 100 described above, the seat-mounting ends 525 of the resilient posts 510, and thus the head contact seat 514, extends at a spacer distance d1 from the inner surface 104 of the shock-absorbing core 102. The spacer distance d1 corresponds substantially to a length of the protruding portion 540 of the resilient post 510. In some embodiments, the spacer distance d1 represents at least about 20% of the length L of the resilient post 510. In some embodiments, the spacer distance d1 represents at least about 30% of the thickness T of the shock-absorbing core 102.

In some embodiments, the length d2 of the core-engaging portion 541 of the resilient post 510 represents at least about 20% of the thickness T of the shock-absorbing core 102. In some other embodiments, the length d2 represents at least about 40% of the thickness T of the shock-absorbing core 102. The length d2 is thus determined to limit the risk of an accidental removal of the shock-absorbing assembly 500 when the resilient posts 510 are detachably mounted to the shock-absorbing core 102. Similarly to the embodiment disclosed above, it is thus understood that the length d2 of the core-engaging portion 541 is not null, so as to ensure a firm connection of the resilient post 510 to the shock-absorbing core 102 (i.e. the core-engaging end 526 is engaged within the shock-absorbing core 102, at the length d2 of the inner surface 104 of the shock-absorbing core 102).

To allow a flexible and resilient displacement of the head contact seat 514 with respect to the shock-absorbing core 102, the resilient posts 510 are at least partially made from a material being more deformable and/or more elastic/resilient/flexible than the material from which the shock-absorbing core 102 is made. For instance, the resilient posts 510 and/or the head contact seat 514 are at least partially made of TPU. As mentioned above, in other embodiments, the resilient posts 510 can be formed integral with the shock-absorbing core 102 and/or the resilient posts 510 and the shock-absorbing core 102 can be made of a similar material. In a non-limitative embodiment, the shock-absorbing core 102 and the resilient posts 510 are single piece, i.e. made integral, and made of TPU. In another non-limitative embodiment, the resilient posts 510 are mounted to the shock-absorbing core 102 and at least partially made of a different material from which the shock-absorbing core 102, which can be more deformable and/or more elastic/resilient/flexible.

Moreover, in particular for comfort purposes, the head contact seat 514 is thin in comparison with the length of the stem 522. For instance, the head contact seat 514 has a thickness t shorter than the thickness T of the shock-absorbing core 102. In the embodiment shown, the thickness t of the head contact seat 514 substantially corresponds to a thickness of the contact seat layer 507. In some embodiments, the thickness t of the head contact seat 514 is shorter than about 10% of the thickness T of the shock-absorbing core 102. In some embodiments, the thickness t of the head contact seat 514 is shorter than about 5% of the thickness T of the shock-absorbing core 102. In some other embodiments, the thickness t of the head contact seat 514 is shorter than about 2% of the thickness T of the shock-absorbing core 102.

In the embodiment shown, aeration apertures 513 are formed in the head contact seat 514 (for instance in the contact seat layer 507 of the body contact seat 514). For instance the aeration apertures 513 are substantially oval in shape and are configured to improve aeration and deformation to conform the head contact seat 514 to the head of the user when the helmet is worn.

It is thus understood that the shock-absorbing assemblies 100, 400, 500 form a head contact seat 114, 414, 514 engageable with a human head portion when the helmet 200 equipped with one of the shock-absorbing assemblies 100, 400, 500 is worn by a user. The spaced-apart resilient posts 110, 510 are dimensioned and their properties (for instance their elasticity and/or their deformability) are chosen so as to contribute to the shock attenuation properties and/or to the shock absorption characteristics of the helmet 200. When the user wearing the helmet 200 receives a shock, the movement of their head in the helmet 200 will be limited by the shock-absorbing assembly 100, 400, 500, and more particularly by the plurality of the spaced-apart resilient posts 110, 510. The spaced-apart resilient posts 110, 510 are indeed configured to be deformed independently from each other, in a plane substantially parallel to their corresponding tangential plane of the inner surface 104 of the shock-absorbing core 102, and/or axially (i.e. along a direction comprising the first axis X1 of their corresponding stem 122). In other words, the head engaging surface 112 of the head contact base 124 of the plurality of spaced-apart resilient posts 110, the inner surface 456 of the head engaging straps 450 and the head-engaging surfaces of the resilient posts 510 and the heat contact seat 514 of the head contact seat assembly 509 are designed to abut against at least a section of the human head portion when the helmet 200 is worn. The head contact seat 114, 414, 514, by being in spaced relationship with the inner surface 104 of the shock-absorbing core 102 and by being mounted thereto via the plurality of spaced-apart resilient posts 110, 510 is thus shaped and designed to be at least one of slidable, displaceable, shearable and twistable with respect to the inner surface 104 of the shock-absorbing core 102. Thus, when the user wearing the helmet 200 receives a shock, the head contact seat 114, 414, 514 undergoes a shearing force causing the head contact seat 114, 414, 514 to move along a plane substantially parallel to the inner surface 104 of the shock-absorbing core 102 and/or a force causing the head contact seat to move in a direction substantially parallel to the longitudinal direction of the corresponding resilient post 110, 510. FIG. 23 represents a possible movement of the heat contact seat 514 with respect to the shock-absorbing core 102. As represented in FIG. 23, in which the shock-absorbing assembly 500 is in a stressed configuration, the spaced-apart resilient posts 510 are deflected (for instance upon reception of a shock by the head of the user). Due to their elasticity, the position of the seat-mounting end 525 with respect to the core engaging end 526 can vary if pressure is applied thereon. However, they return to their original shape once the pressure is removed.

The combination of a plurality of spaced-apart resilient posts 110, 410, 510 being deflectable and resilient provides a rotational impact protection to the helmet 200, i.e. they allow the resilient core 102 and the outer shell 210 of the helmet 200 to move/slide relative to the wearer's head, thereby adding more protection against rotational violence to the brain caused by angled/oblique impacts.

Figure 24:
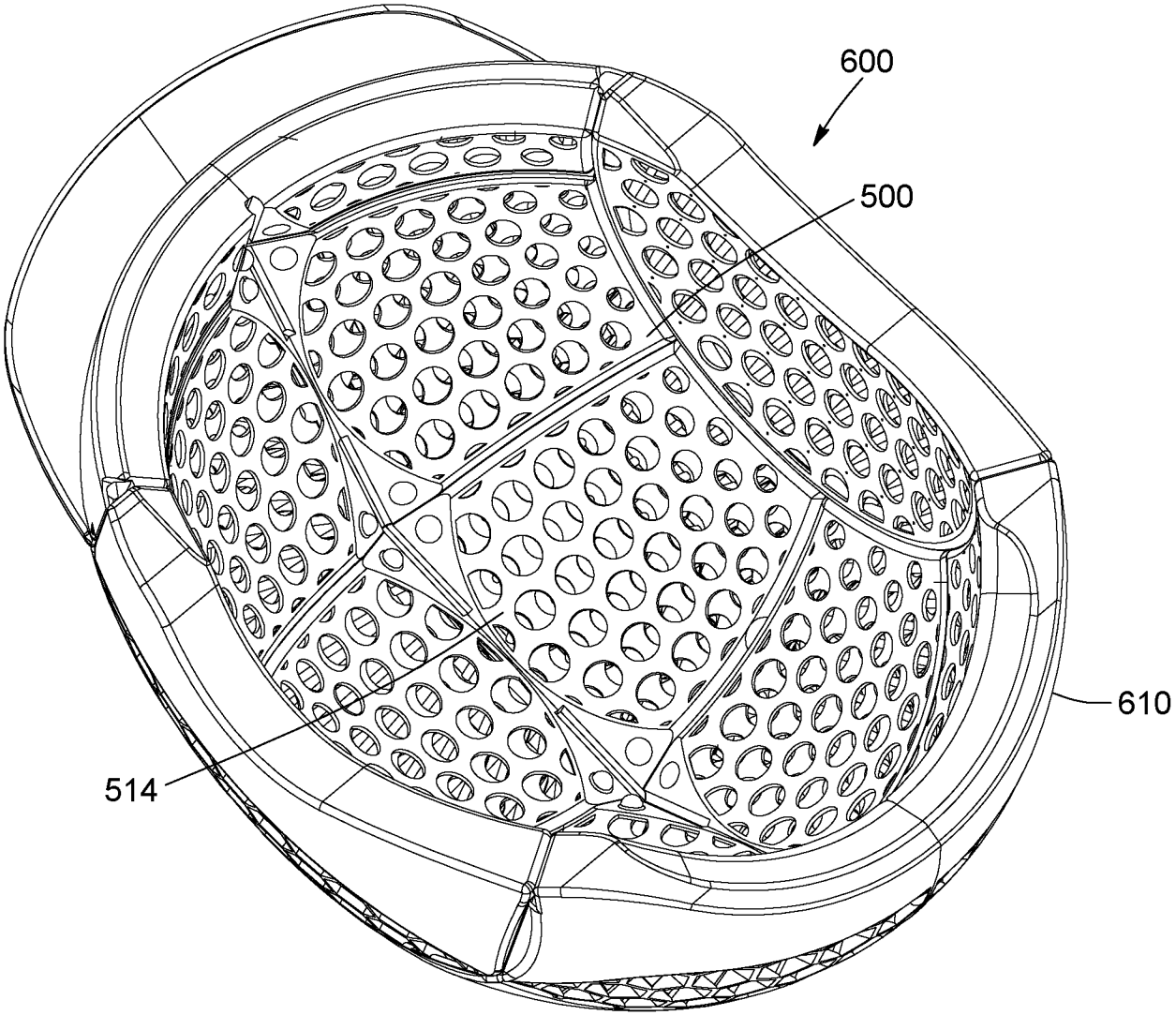
FIG. 24 is a bottom perspective view of a helmet in accordance with another embodiment.
Figure 25:
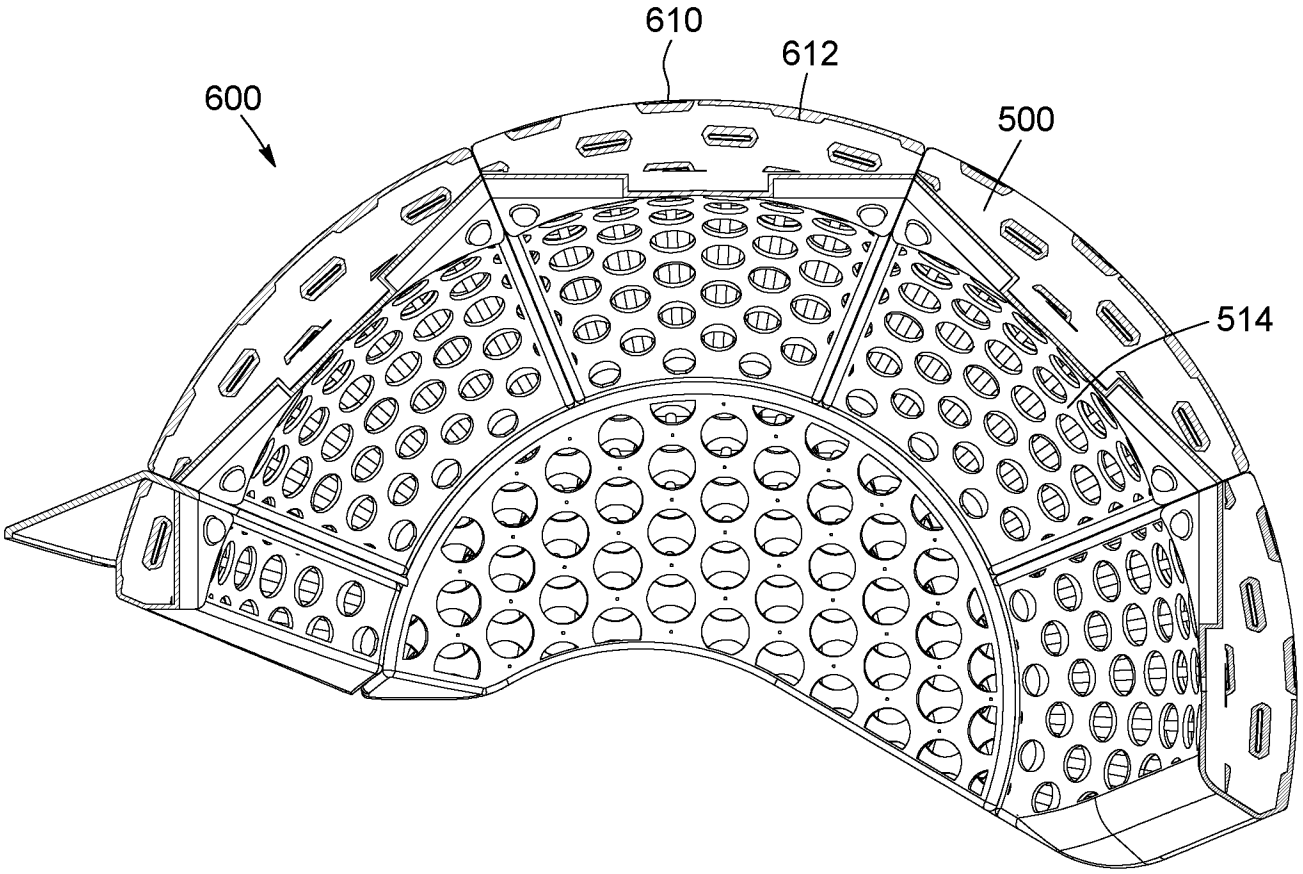
FIG. 25 is a cross-section view of the helmet of FIG. 24.
Figure 26:
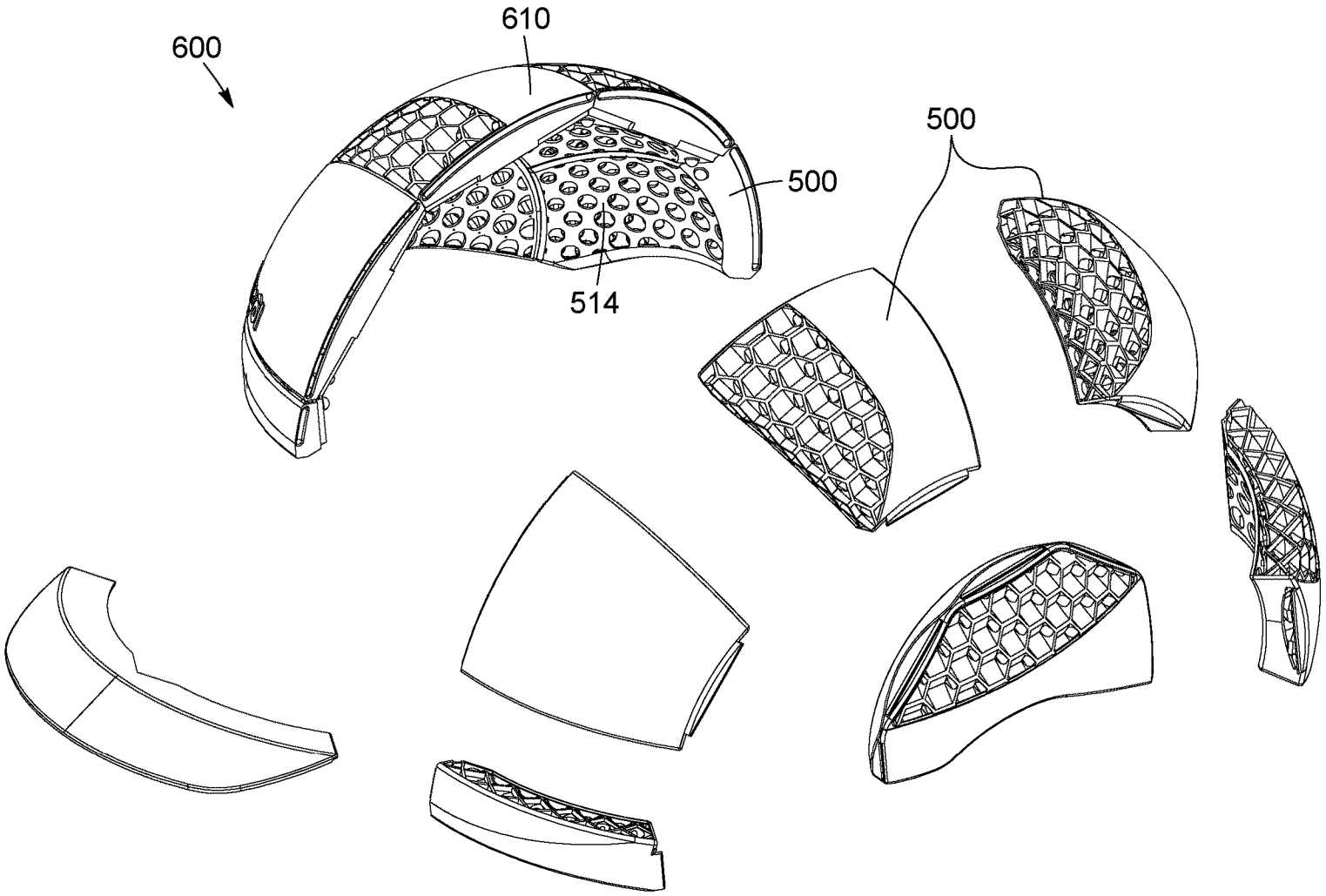
FIG. 26 is a partially exploded view of the helmet of FIG. 24.

FIGS. 24 to 26 represent another embodiment of a helmet 600. The helmet 600 comprises an outer shell 610 with an inner surface 612, and a shock-absorbing assembly 500 secured—directly, in the embodiment shown—to the inner surface 612 of the outer shell 610. In the embodiment shown, the outer surface 106 of the shock-absorbing core 102 of the shock-absorbing assembly 500 is secured to the inner surface 612 of the outer shell 610. As represented in FIG. 26, the helmet 600 comprises a plurality of sections of shock-absorbing assemblies 500 connected to each other, wherein each section has its own shape. In some embodiments, an area of the outer surface 106 of the shock-absorbing core 102 of the connected shock-absorbing assemblies 500 represents at least about 50% of an area of the inner surface 612 of the outer shell 610. In some other embodiments, the area of the outer surface 106 of the shock-absorbing core 102 of the connected shock-absorbing assemblies 500 represents at least about 60% of the area of the inner surface 612 of the outer shell 610. In some other embodiments, the area of the outer surface 106 of the shock-absorbing core 102 of the connected shock-absorbing assemblies 500 represents at least about 70% of the area of the inner surface 612 of the outer shell 610. In yet some other embodiments, the area of the outer surface 106 of the shock-absorbing core 102 of the connected shock-absorbing assemblies 500 represents at least about 90% of the area of the inner surface 612 of the outer shell 610.

Figure 27:
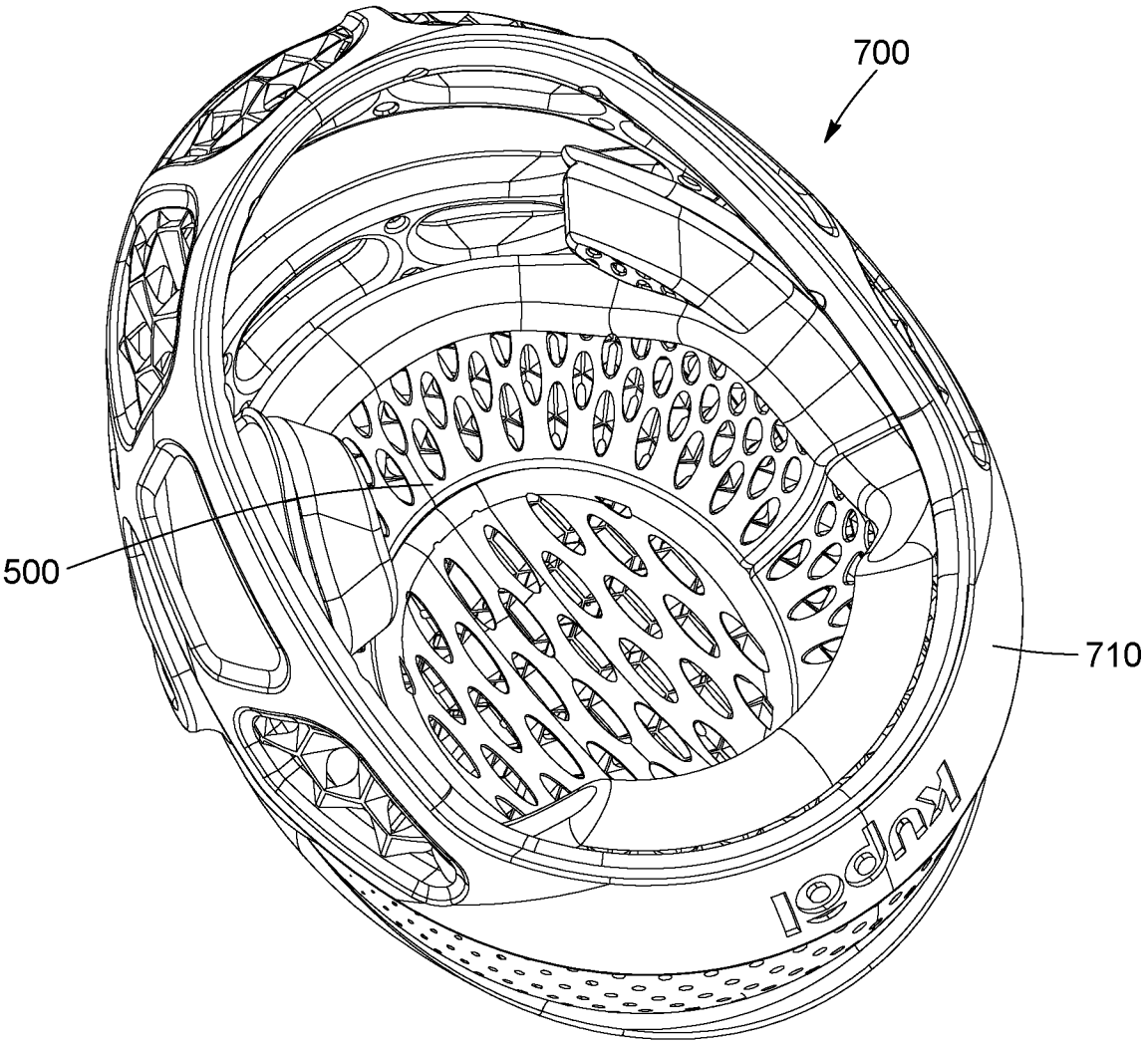
FIG. 27 is a bottom perspective view of a helmet in accordance with another embodiment.
Figure 28:
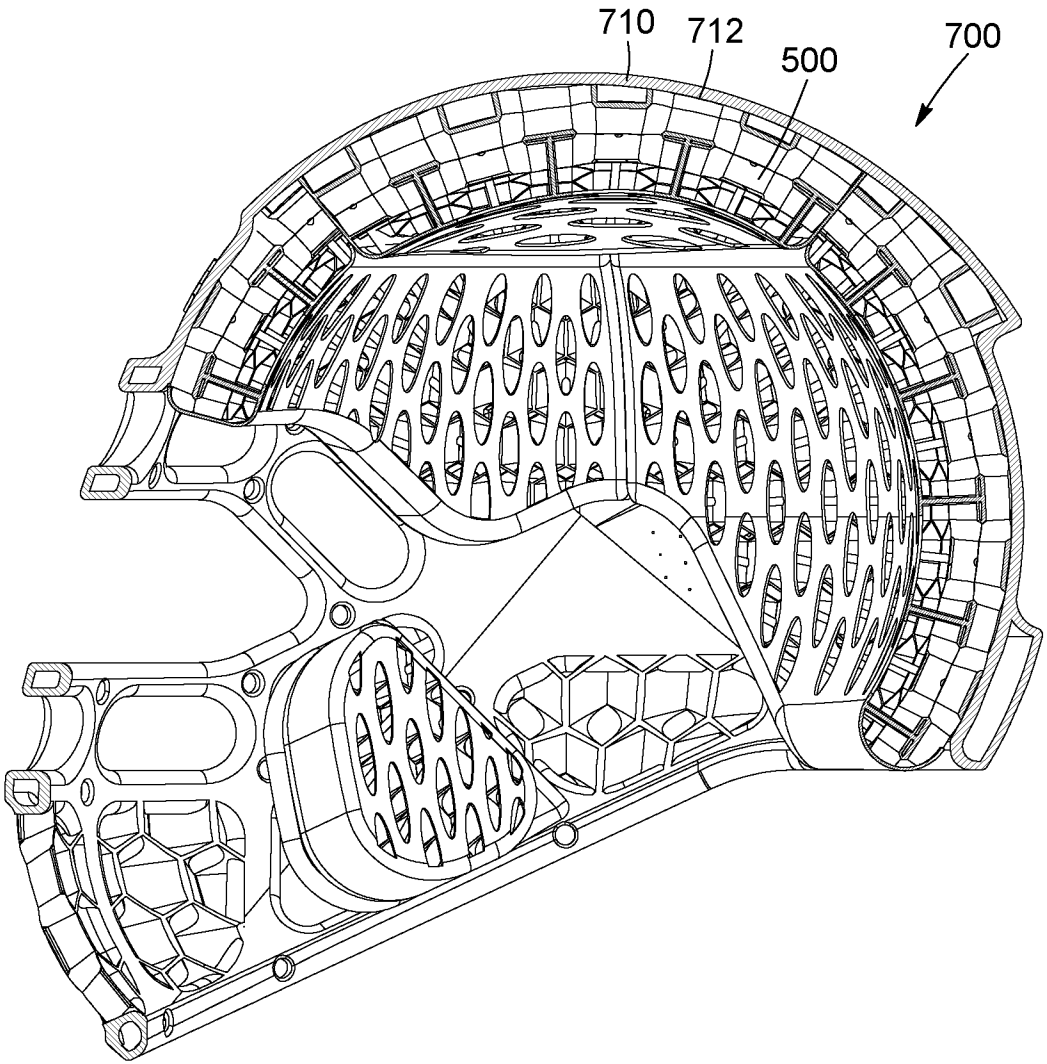
FIG. 28 is a cross-section view of the helmet of FIG. 27.

FIGS. 27 and 28 represent another embodiment of a helmet 700—for instance a football helmet. The helmet 700 comprises an outer shell 710 with an inner surface 712, and a plurality of shock-absorbing assemblies 500 secured—directly, in the embodiment shown—to the inner surface 712 of the outer shell 710, the shock-absorbing assemblies 500 being connected to each other.

Resilient Pads

In the embodiment of FIGS. 1 to 4, the shock-absorbing assembly 100 of the helmet 200 further comprises a plurality of resilient pads 150 extending from the outer surface 106 of the shock-absorbing core 102 and designed to contact the inner surface 212 of the outer shell 210. It could alternatively be conceived a helmet 200 having a plurality of resilient pads 150 that would extend from the inner surface 212 of the outer shell 210 and that would be designed to contact the outer surface 106 of the shock-absorbing core 102. It could also be conceived helmets having not resilient pads (i.e. in which the outer surface 106 of the shock-absorbing core 102 would be directly in contact with the inner surface 212 of the outer shell 210).

In the embodiment shown, the resilient pads 150 have a similar shape, so that the following description of one of the resilient pads 150 will apply to any of them. It could however also be conceived a helmet 200 having resilient pads 150 with different shape, dimensions, structure, density and/or arrangement with respect to the shock-absorbing core 102.

As represented in FIGS. 10 to 14, the resilient pad 150 defines a second axis X2 and has a mounting base 152 and a resilient head 154 protruding from the mounting base 152. It is understood that, in the embodiment shown, the resilient head 154 protrudes outwardly with respect to the 3D internal structure 116 of the shock-absorbing core 102. In the shown embodiment, the resilient head 154 has a substantially semi-spherical shape with an inner cavity 156 formed therein. The inner cavity 156 comprises a substantially semi-spherical portion 158 and a substantially cylindrical portion 160 that opens in the mounting base 152, defining therein a base aperture 162. The substantially cylindrical portion 160 extends along an axis substantially aligned with the second axis X2 of the resilient pad 150.

The mounting base 152 comprises a mounting body 164 having a substantially cylindrical shape, extending along an axis substantially aligned with the second axis X2 of the resilient pad 150; the mounting body 164 has a first end 166 from which the resilient head 154 extends and an opposed second end 168. The mounting base 152 further comprises a mounting ring 170 extending outwardly from an outer surface of the second end 168 of the mounting body 164. In this specific context, the term "outer" relative to the surface of the mounting body 164 should be understood with respect to the inner cavity 156 of the resilient pad 150. It is thus understood that the cross-section S1 of the mounting base 152 considered in a plane substantially perpendicular to the second axis X2 at the first end 166 of the mounting body 164 is smaller than the outer cross section S2 of the mounting base 152 considered in a plane substantially perpendicular to the second axis X2 at the mounting ring 170, i.e. at the junction of the mounting body 164 and the resilient head 154. In other words, the mounting base 152 comprises a shoulder 165 on the outer surface of the mounting body 164.

In some embodiments, considered along the second axis X2 of the resilient pad 150, a length of the mounting base 152 represents less than about 50% of a length of the resilient head 154. In some other embodiments, considered along the second axis X2 of the resilient pad 150, the length of the mounting base 152 represents less than about 25% of the length of the resilient head 154. In yet some other embodiments, considered along the second axis X2 of the resilient pad 150, the length of the mounting base 152 represents less than about 10% of the length of the resilient head 154.

The resilient head 154 comprises a peripheral wall 155, which defines the inner cavity 156, and a plurality of spaced-apart ribs 171 extending outwardly from an outer surface of the resilient head 154. The ribs 171 extend from the apex of the resilient head 154 towards the junction with the mounting body 164. In the embodiment shown, the thickness of the ribs 171 increases from the apex towards the mounting body 164. In the embodiment shown, the resilient head 154 includes four reinforcing ribs 171, with an angle of 90 degrees being defined between two adjacent reinforcing ribs 171.

In the shown embodiment, the resilient pad 150 is made of a single element and is at least partially made from injection molded plastic having resilient properties. It could also be conceived a resilient pad 150 that would be at least partially made from a 3D-printed material and, more particularly, a 3D-printed plastic having resilient properties. In some embodiments, the resilient pad 150 is at least partially deformable and has elastic/resilient properties. In some embodiments, the resilient pad 150 is made from a material being more deformable and/or more elastic than the material from which the shock-absorbing core 102 is made. For instance, the resilient pad 150 is at least partially made of TPU.

Figure 3:
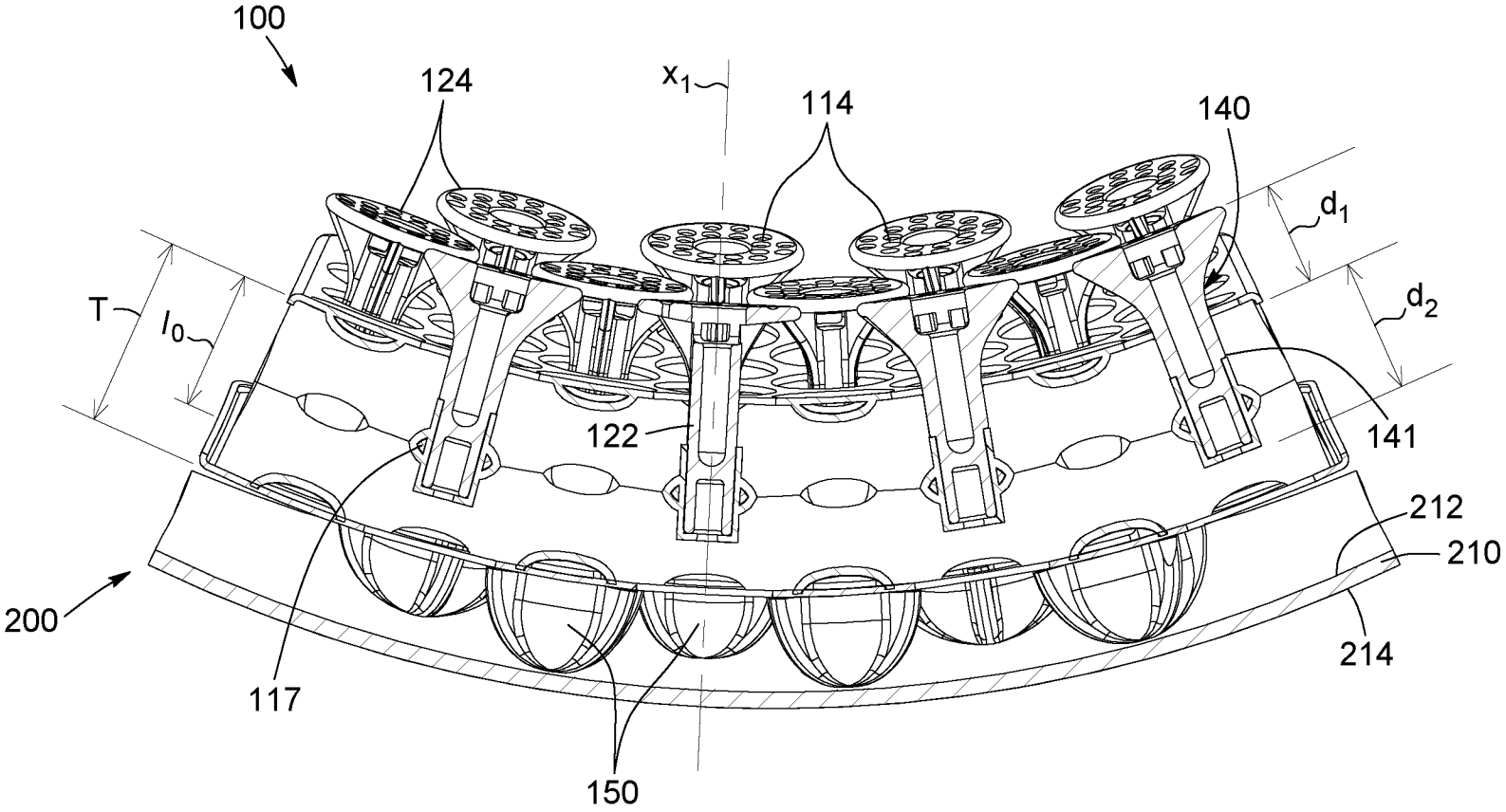
FIG. 3 is a cross-section view of the portion of the helmet of FIG. 1 along cross-section lines A-A of FIG. 2.

In the shown embodiment, the resilient pad 150 is configured to be mounted to the outer surface 106 of the shock-absorbing core 102. As represented in FIG. 3, the mounting base 152 of the resilient pad 150 is dimensioned to be introduced in one of the outer ports 119 that is defined in the outer surface 106. The dimensions of the outer port 119 are substantially equal to the first cross section S1 of the mounting base 152 at the first end 166 of the mounting body 164 and are substantially smaller than the cross section S2 of the mounting base 152 considered in a plane substantially perpendicular to the second axis X2 at the second end 168 of the mounting body 164. In other words, the mounting base 152 is dimensioned so that the mounting ring 170 prevents—or at least limits—the removal of the mounting base 152 out from the outer port 119. In yet other words, when the resilient pad 150 is mounted to the shock-absorbing core 102, the outer surface 106 is sandwiched between the mounting ring 170 and the resilient head 154.

In the embodiment shown, the outer port 119 corresponds to the opening of the receiving opening 108 in the outer surface 106 of the shock-absorbing core 102. It could also be conceived outer ports 119 formed independently from the receiving openings 108.

In some embodiments, a resilient pad 150 is mounted to the outer surface 106 in correspondence with a resilient post 110 mounted to the inner surface 104 of the shock-absorbing core 102. In some other embodiments, at least some resilient pads 150 could be mounted to the outer surface 106 of the shock-absorbing core 102 alternately with the mounting of at least some spaced-apart resilient posts 110. It is appreciated that the number of resilient pads 150 and spaced-apart resilient posts 110 can be different.

In some embodiments, the helmet 200 comprises less resilient pads 150 than spaced-apart resilient posts 110. In some embodiments, the number of resilient pads 150 represents more than about 90% of the number of resilient posts 110. In yet some embodiments, the number of resilient pads 150 represents more than about 80% of the number of resilient posts 110. In yet some embodiments, the number of resilient pads 150 represents more than about 70% of the number of resilient posts 110.

The resilient pads 150 are dimensioned and their properties (for instance their elasticity and/or their deformability) are chosen so as to further contribute to the shock attenuation properties and/or to the shock absorption characteristics of the helmet 200. The resilient pads 150 are thus designed to allow a substantially radial displacement of the shock-absorbing core 102, for instance in case of a displacement of the head of the user in the helmet 200 resulting from a shock.

The resilient pads 150 are compressible/deformable and resilient. In an embodiment, the base aperture 162 is open into the absorbent core 102. Therefore, the resilient head 154 can be compressed and deformed when pressure is applied thereon. Furthermore, the resilient pads 150, including the resilient heads 154, return to their original shape once the pressure is removed.

In some embodiments, the length l1 of the portion of the resilient pad 150 protruding from the outer surface 106 of the shock-absorbing core 102, considered along the second axis X2 (i.e. the length of the resilient head 154 considered along the second axis) is substantially equal to the spacer distance d1 at which the head contact base 124 of the resilient post 110 extends from the inner surface 104 of the shock-absorbing core 102.

In some embodiments, the thickness T of the shock-absorbing core 102 is about 1.5 times greater than the length l1. In some other embodiments, the thickness T of the shock-absorbing core 102 is about 2 times greater than the length l1.

It is appreciated that the shape, the configuration, the density, and the location of the resilient pads 150 with regards to the shock-absorbing core 102 can vary from the embodiment shown.

Shock-Absorbing Kit

The present shock-absorbing assemblies 100, 400, 500 may also be available as a kit, with corresponding components for assembling a resulting fully assembled and operational shock-absorbing assembly 100, 400, 500 as described previously, to be mounted to the inner surface 212 of the outer shell 210 of a helmet 200. The kit comprises a shock-absorbing core 102 having an inner surface 104 with inner ports 118 formed therein and, optionally, an outer surface 106 with outer ports 119 formed therein.

The kit might further comprise a plurality of deformable spaced-apart resilient posts 110, 510 having an outer end mounted to the shock-absorbing core 102, outwardly from the inner surface 104 and, in an embodiment, between the inner surface 104 and the outer surface 106. The resilient posts 110, 510 extend through to the inner ports 118, The resilient posts 110, 510 have a portion 140, 540 protruding inwardly from the inner surface 104 of the shock-absorbing core 102 (i.e. towards the wearer's body) when each resilient post 110, 510 is connected to/mounted to the shock-absorbing core 102. In some implementations, each one of the resilient posts 110 has body/head contact base 124 spaced-apart from the inner surface 104 when the resilient post 110 extends inwardly from the shock-absorbing core 102. In another implementations, a plurality of the resilient posts 510 are connected to one another by having a continuous body/head contact base defining the body contact seat 514. In another embodiment, the kit might comprise a body contact seat assembly comprising a plurality of resilient posts 110, 510 designed to have a protruding portion 140, 540 extending inwardly (i.e. towards the wearer's body) from the shock-absorbing core 102 to define together a body contact seat 114, 414, 514 spaced apart from the inner surface 104 of the shock-absorbing core 102. Since the resilient posts 110, 510 are resilient and deformable, the body contact seat 114, 414, 514 is at least one of slidable, displaceable, shearable, and twistable with respect to the inner surface 104 of the shock-absorbing core 102 when mounted thereto.

The kit might further comprise a plurality of body contact seat assemblies configurable in an adjacent configuration.

In some embodiments, the kit might further comprise at least one body-engaging strap—for instance head-engaging straps 450—couplable to the body-engaging surfaces 412 of at least some of the plurality of resilient posts 110.

The kit might further comprise a plurality of resilient pads 150 configured to be mounted to one of the outer shell 210 and the shock-absorbing core 102 and extending towards the other one of the outer shell 210 and the shock-absorbing core 102 to define a spacing in-between. If the resilient pads 150 are mounted to the shock-absorbing core 102, they can extend through the outer ports 119. The resilient pads 150 provides a resiliently cushioning between the inner surface of the outer shell 210 and the outer surface 106 of the shock-absorbing core 102 when the kit is mounted to the helmet 200 or any other suitable body protection device.

It is appreciated that the body protection device, the helmet 200 or the kit can be provided with one or both of the resilient posts 110, 510 and the resilient pads 150. Furthermore, in alternative embodiments (not shown), the resilient posts 110, 510 and/or the resilient pads 150 can be mounted to the absorbing core 102 without having a portion thereof being inserted into ports defined therein. For instance, the resilient posts 110 and/or the resilient pads 150 can be fastened, glued, and the like to the absorbing core (i.e. to one of the inner surface 104 and the outer surface 106 thereof).

Several alternative embodiments and examples have been described and illustrated herein. The embodiments of the invention described above are intended to be exemplary only. A person of ordinary skill in the art would appreciate the features of the individual embodiments, and the possible combinations and variations of the components. A person of ordinary skill in the art would further appreciate that any of the embodiments could be provided in any combination with the other embodiments disclosed herein. It is understood that the invention may be embodied in other specific forms without departing from the central characteristics thereof.

The present examples and embodiments, therefore, are to be considered in all respects as illustrative and not restrictive, and the invention is not to be limited to the details given herein. Accordingly, while the specific embodiments have been illustrated and described, numerous modifications come to mind. The scope of the invention is therefore intended to be limited solely by the scope of the appended claims.

Any publications, including patents, patent applications and articles, referenced or mentioned in this specification are herein incorporated in their entirety into the specification, to the same extent as if each individual publication was specifically and individually indicated to be incorporated herein. In addition, citation or identification of any reference in the description of some embodiments of the invention shall not be construed as an admission that such reference is available as prior art to the present invention.

The invention claimed is:

1. A shock-absorbing assembly for protecting a human body part, the shock-absorbing assembly comprising:

a shock-absorbing core including an inner surface configured to face at least a portion of the human body part and an opposed outer surface; and a body contact seat assembly comprising:

a plurality of spaced-apart resilient posts mounted to the shock-absorbing core, each one of said plurality of resilient posts having a portion protruding from the inner surface of the shock-absorbing core towards the human body part; and a body contact seat mounted to the shock-absorbing core via the protruding portions of said plurality of resilient posts, so that the body contact seat is in spaced relationship with the inner surface of the shock-absorbing core and at least one of slidable, displaceable, shearable, and twistable with respect to the inner surface thereof.

2. The shock-absorbing assembly according to claim 1, wherein the shock-absorbing core comprises a plurality of spaced-apart receiving openings extending therethrough and a plurality of inner ports formed in the inner surface with the inner ports being in communication with a respective one of the receiving openings, and wherein each one of said plurality of spaced-apart resilient posts comprises a stem extending at least partially into one of said plurality of receiving openings, the stem comprising:

a core-engaging end mounted to the shock-absorbing core; and a seat-mounting end, opposed to the core-engaging end, and being located outside the shock-absorbing core;

wherein the body contact seat extends from the seat mounting ends of the stems.

3. The shock-absorbing assembly according to claim 1, wherein each one of said plurality of spaced-apart resilient posts comprises a stem having a section extending into the shock-absorbing core and a section extending outwardly from the shock-absorbing core, wherein the section extending into the shock-absorbing core comprises a core-engaging end mounted to the shock-absorbing core and the section extending outwardly from the shock-absorbing core comprises a seat-mounting end with the body contact seat extending from the seat-mounting ends of the stems.

4. The shock-absorbing assembly according to claim 3, wherein the shock-absorbing core comprises a 3D internal structure extending between the inner surface and the outer surface, and wherein the core-engaging end of the stem is formed integral with the 3D internal structure of the shock absorbing core.

5. The shock-absorbing assembly according to claim 3, wherein the core-engaging end of the stem is detachably engageable with the shock-absorbing core, and wherein the core-engaging end comprises a blocking head configured to limit the disengagement of the resilient post from the shock-absorbing core.

6. The shock-absorbing assembly according to claim 1, wherein said plurality of spaced-apart resilient posts are at least partially made of TPU.

7. The shock-absorbing assembly according to claim 1, wherein the body contact seat defines a body contact surface extending substantially parallel to the inner surface of the shock-absorbing core and spaced-apart thereof.

8. The shock-absorbing assembly according to claim 1, wherein the body contact seat comprises a plurality of body contact bases, each one being located at an end of a respective one of the resilient posts and spaced-apart from the inner surface of the shock-absorbing core, each one of the body contact bases having a body-engaging surface with a combination of the body-engaging surfaces defining the body contact seat.

9. The shock-absorbing assembly according to claim 1, wherein the body contact seat is mounted to and supported by a plurality of the resilient posts, and wherein the body contact seat comprises a contact seat layer supported by the plurality of the resilient posts and having a plurality of aeration apertures formed therein.

10. The shock-absorbing assembly according to claim 1, wherein the human body part is a human head and the body contact seat at least partially conforms to the human head to at least partially cover a portion thereof.

11. A shock-absorbing assembly engageable with a human body part, comprising:

a shock-absorbing core including an inner surface configured to face at least a section of the human body part and an opposed outer surface, the shock-absorbing core comprising a plurality of spaced apart receiving openings extending therethrough and a plurality of inner ports formed in the inner surface, the inner ports being in communication with a respective one of the receiving openings;

a plurality of spaced-apart resilient posts mounted to the shock-absorbing core, each one of said plurality of resilient posts having a body, a portion protruding from the inner surface of the shock-absorbing core towards the human body part and a body-engaging surface spaced-apart from the inner surface of the shock absorbing core, the body-engaging surfaces of said plurality of resilient posts defining together a body contact seat, the body of each one of said plurality of spaced-apart resilient posts having:

a stem having a section extending into one of the plurality of receiving openings of the shock-absorbing core and a section extending outwardly from the shock-absorbing core, the section extending into the shock-absorbing core having a core engaging end mounted to the shock-absorbing core, the section extending outwardly from the shock absorbing core having a seat-mounting end; and a body contact base extending from the seat-mounting end of the stem, the body contact base defining the body-engaging surface configured to face and abut against at least a section of the human body part, the body contact bases of the plurality of spaced-apart resilient posts defining together a discontinuous surface forming the body contact seat, the plurality of spaced-apart resilient posts being arranged at a distance from each other sufficient for the body contact bases to be spaced-apart from each other; and a body-engaging strap coupling the body-engaging surfaces of at least some of the plurality of spaced-apart resilient posts, said at least one body-engaging strap comprising a linking portion extending between two spaced-apart resilient posts and at least two post-mounting portions securable to the body contact base of said two resilient posts.

12. The shock-absorbing assembly according to claim 11, wherein the body-engaging surface is substantially parallel to a tangential plane defined at an intersection between the inner surface of the shock-absorbing core and the stem of the resilient post.

13. The shock-absorbing assembly according to claim 11, wherein the body contact bases of said plurality of resilient posts are formed integral with each other so that the body contact bases define together a substantially continuous surface forming the body contact seat.

14. A helmet engageable with a human head portion, comprising:

an outer shell including an inner surface and an outwardly facing surface; and a shock-absorbing assembly according to claim 1, wherein the outer surface of the shock-absorbing core is connected to the inner surface of the outer shell.

15. A shock-absorbing kit designed to be secured to an inner surface of an outer shell of a body protection device for a human body part, the shock-absorbing kit comprising:

a shock-absorbing core including an inner surface configured to face at least a portion of the human body part and an opposed outer surface engageable with the inner surface of the outer shell; and a body contact seat assembly comprising:

a plurality of resilient posts designed to be mounted to the shock-absorbing core with a portion protruding from the inner surface of the shock-absorbing core and towards the portion of the human body part when mounted to the shock-absorbing core; and a body contact seat designed to be connected to the shock-absorbing core via the protruding portions of said plurality of resilient posts, for the body contact seat to be in spaced relationship with the inner surface of the shock-absorbing core and at least one of slidable, displaceable, shearable and twistable with respect to the inner surface of the shock absorbing core when connected thereto.

16. The shock-absorbing kit according to claim 15, wherein the body contact seat assembly comprises a plurality of body contact seat assemblies connectable to each other to cover the portion of the human body part.

17. The shock-absorbing kit according to claim 15, wherein the body contact seat comprises a plurality of head contact bases, each one being located at an end of a respective one of the resilient posts and spaced-apart from the inner surface of the shock-absorbing core, each one of the head contact bases having a body-engaging surface with a combination of the body-engaging surfaces defining the body contact seat.

* * * * *